US011193456B1

(12) United States Patent
Yoshioka et al.

(10) Patent No.: US 11,193,456 B1
(45) Date of Patent: Dec. 7, 2021

(54) EGR SYSTEM

(71) Applicant: AISAN KOGYO KABUSHIKI KAISHA, Obu (JP)

(72) Inventors: Mamoru Yoshioka, Nagoya (JP); Kaisho So, Nagoya (JP); Takashi Bessho, Chiryu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 17/318,425

(22) Filed: May 12, 2021

(30) Foreign Application Priority Data

May 27, 2020 (JP) ..... JP2020-092312

(51) Int. Cl.
*F02M 26/35* (2016.01)
*F02M 26/04* (2016.01)
*F02M 26/17* (2016.01)

(52) U.S. Cl.
CPC ..... *F02M 26/35* (2016.02); *F02M 26/04* (2016.02); *F02M 26/17* (2016.02)

(58) Field of Classification Search
CPC ..... F02M 26/35; F02M 26/17; F02M 26/04
See application file for complete search history.

(56) References Cited

U.S. PATENT DOCUMENTS

2011/0232301 A1* 9/2011 He ..... F02M 26/35 62/3.2
2018/0179999 A1* 6/2018 Yoshioka ..... F01M 13/022

FOREIGN PATENT DOCUMENTS

JP 2018-044518 A 3/2018
JP 2018-105180 A 7/2018

* cited by examiner

*Primary Examiner* — Xiao En Mo
(74) *Attorney, Agent, or Firm* — Oliff PLC

(57) ABSTRACT

An EGR system is configured to allow a part of exhaust gas discharged from an engine to an exhaust passage to flow as an EGR gas to an intake passage through an EGR passage to return to the engine. The EGR system includes a heating film provided on an inner wall of at least one of the intake passage through which the EGR gas flows, i.e., an intake manifold, and the EGR passage, at least one pair of a positive electrode and a negative electrode to energize the heating film, a water temperature sensor and an intake temperature for detecting a warm-up state of the intake passage and the EGR passage, and an electronic control unit configured to control energization of the heating film from before start of EGR based on the detected warm-up state.

10 Claims, 33 Drawing Sheets

FIG. 12

AL-ON : ALWAYS ON

| STHA[°C] \ STHW[°C] | -20 | -10 | 0 | 10 | 20 | 30 | 40 | 50 | 60 | 80 | 100 |
|---|---|---|---|---|---|---|---|---|---|---|---|
| -20 | AL-ON | AL-ON | AL-ON | AL-ON | AL-ON | AL-ON | AL-ON | AL-ON | AL-ON | AL-ON | AL-ON |
| -10 | | 2500 | 2100 | 1800 | 1500 | 1400 | 1200 | 1000 | 800 | 600 | 300 |
| 0 | | | 1600 | 1500 | 1400 | 1200 | 1000 | 800 | 600 | 300 | 100 |
| 10 | | | | 1300 | 1200 | 1000 | 800 | 600 | 450 | 250 | 100 |
| 20 | | | | | 900 | 800 | 750 | 550 | 400 | 200 | 100 |
| 30 | | | | | | 600 | 500 | 400 | 300 | 150 | 60 |
| 40 | | | | | | | 350 | 250 | 200 | 100 | 0 |
| 50 | | | | | | | | 100 | 30 | 0 | 0 |

THT [sec.]

THT [sec.]

FIG. 15

AL-ON : ALWAYS ON

| STHA[°C] \ STHW[°C] | −20 | −10 | 0 | 10 | 20 | 30 | 40 | 50 | 60 | 80 | 100 |
|---|---|---|---|---|---|---|---|---|---|---|---|
| −20 | AL-ON | AL-ON | AL-ON | AL-ON | AL-ON | AL-ON | AL-ON | AL-ON | AL-ON | AL-ON | AL-ON |
| −10 | | 90 | 90 | 90 | 87 | 85 | 85 | 85 | 85 | 80 | 80 |
| 0 | | | 90 | 90 | 85 | 85 | 83 | 83 | 83 | 80 | 80 |
| 10 | | | | 90 | 85 | 85 | 83 | 80 | 75 | 70 | 70 |
| 20 | | | | | 85 | 85 | 83 | 75 | 70 | 70 | 70 |
| 30 | | | | | | 85 | 82 | 75 | 65 | 65 | 65 |
| 40 | | | | | | | 80 | 75 | 62 | 62 | 62 |
| 50 | | | | | | | | 65 | 60 | 60 | 60 |

THWCT [°C]

THWCT [°C]

FIG. 17

| STHA[°C] \ STHW[°C] | −20 | −10 | 0 | 10 | 20 | 30 | 40 | 50 | 60 | 80 | 100 |
|---|---|---|---|---|---|---|---|---|---|---|---|
| −20 | 3 | 3 | 2.8 | 2.7 | 2.6 | 2.5 | 2.4 | 2.3 | 2.2 | 2.1 | 2 |
| −10 | | 2.8 | 2.6 | 2.5 | 2.4 | 2.25 | 2.15 | 2 | 1.9 | 1.85 | 1.8 |
| 0 | | | 2.4 | 2.3 | 2.1 | 2 | 1.9 | 1.8 | 1.75 | 1.68 | 1.6 |
| 10 | | | | 2 | 1.85 | 1.75 | 1.65 | 1.58 | 1.5 | 1.45 | 1.4 |
| 20 | | | | | 1.75 | 1.65 | 1.55 | 1.45 | 1.35 | 1.28 | 1.2 |
| 30 | | | | | | 1.5 | 1.4 | 1.3 | 1.2 | 1.1 | 1 |
| 40 | | | | | | | 1.25 | 1.15 | 1 | 0.9 | 0.8 |
| 50 | | | | | | | | 1 | 0.85 | 0.7 | 0.6 |

SAMP [A]

SAMP [A]

FIG. 18

| THA(°C) | −20 | −10 | 0 | 10 | 20 | 30 | 40 | 50 |
|---|---|---|---|---|---|---|---|---|
| LAMP(A) | 1.5 | 1.25 | 1 | 0.8 | 0.6 | 0.4 | 0.3 | 0.2 |

FIG. 22

| BSTHA (°C) | −20 | −10 | 0 | 10 | 20 | 30 | 40 | 50 |
|---|---|---|---|---|---|---|---|---|
| TPHT (sec.) | 30 | 30 | 30 | 20 | 20 | 20 | 15 | 10 |

FIG. 27

| Δ THW(°C) | 0 | 5 | 10 | 20 | 25 | 30 | 40 | 50 |
|---|---|---|---|---|---|---|---|---|
| Δ THWAMP(A) | 2 | 1.75 | 1.5 | 1 | 0.75 | 0.5 | 0.1 | 0 |

EGR SYSTEM

CROSS-REFERENCE TO RELATED APPLICATIONS

This application is based upon and claims the benefit of priority to Japanese Patent Application No. 2020-092312 filed on May 27, 2020, the entire contents of which are incorporated herein by reference.

BACKGROUND

Technical Field

This disclosure relates to an EGR system configured to allow a part of exhaust gas discharged from an engine to an exhaust passage to flow as EGR gas to an intake passage through an EGR passage to return to the engine.

Related Art

As the above type of technique, there has conventionally been known a technique: "Intake manifold", disclosed in for example Japanese unexamined patent application publication No. 2018-044518 (JP 2018-044518A). In this technique, an intake manifold is provided with a gas distribution part for distributing auxiliary gas (EGR gas, PCV gas, etc.) to a plurality of branch pipes for distributing intake air to corresponding cylinders of an engine. Next to this gas distribution part, there is provided a hot water passage part for flowing hot water warmed through the use of cooling water for the engine. Further, a partition wall between the gas distribution part and the hot water passage part is made of a material having good thermal conductivity (a resin material that contains carbon powder or an insert-molded metal plate). The gas distribution part is efficiently kept warm by the heat of hot water in the hot water passage part to prevent the generation of condensed water and the freezing thereof in the gas distribution part.

SUMMARY

Technical Problem

In the technique disclosed in JP 2018-44518A, however, even though the partition wall located between the gas distribution part and the hot water passage is made of the material having good thermal conductivity, the temperature of the hot water depends on a warm-up state of the engine and therefore it would take long to raise the temperature of the gas distribution part and further it would be difficult to accurately control the temperature of the gas distribution part.

The present disclosure has been made to address the above problems and has a purpose to provide an EGR system capable of increasing the temperature of the inner wall of at least one of an intake passage through which the EGR gas flows and an EGR passage with good responsivity and accurately control the relevant temperature.

Means of Solving the Problem

To achieve the above purpose, one aspect of the present disclosure provides an EGR system configured to allow a part of exhaust gas discharged from an engine to an exhaust passage to flow as an EGR gas to an intake passage through an EGR passage to return to the engine, the EGR system comprising: a heating film provided on an inner wall of at least one of the intake passage through which the EGR gas is allowed to flow and the EGR passage; at least one pair of a positive electrode and a negative electrode to energize the heating film; a warm-up state detecting unit configured to detect a warm-up state of the intake passage and the EGR passage; and an energization control unit configured to control energization of the heating film based on the detected warm-up state from before start of EGR.

The above configuration can increase the temperature of the inner wall of at least one of the intake passage that allows EGR gas to flow and the EGR passage can be increased with good responsivity and accurately control the relevant temperature. Consequently, this configuration can prevent the generation of condensed water in at least one of the intake passage through which EGR gas can flow and the EGR passage at the start of EGR (exhaust gas recirculation).

BRIEF DESCRIPTION OF THE DRAWING

FIG. 12 is a required energization time map which is referred to in order to obtain a required energization time according to an at-startup intake temperature and an at-startup cooling water temperature in the first embodiment;

FIG. 15 is an energization-cutoff cooling water temperature map which is referred to in order to obtain an energization-cutoff cooling water temperature according to an at-startup intake temperature and an at-startup cooling water temperature in the second embodiment;

FIG. 17 is an energization-start current value map which is referred to in order to obtain an energization-start current value corresponding to an at-startup intake temperature and an at-startup cooling water temperature in a third embodiment;

FIG. 18 is a lower-limit current value map which is referred to in order to obtain a lower-limit current value according to a cooling water temperature in the third embodiment;

FIG. 22 is a pre-energization time map which is referred to in order to obtain a pre-energization time according to a pre-startup intake temperature in the fourth embodiment;

FIG. 27 is an additional current value map which is referred to in order to obtain an additional current value according to a water temperature difference in the seventh embodiment;

DETAILED DESCRIPTION OF THE EXEMPLARY EMBODIMENTS

A detailed description of several embodiments of an EGR system, embodied as a gasoline engine system, will now be given.

First Embodiment

A first embodiment will be firstly described in detail with reference to the drawings.

(Engine System)

Figure 1:
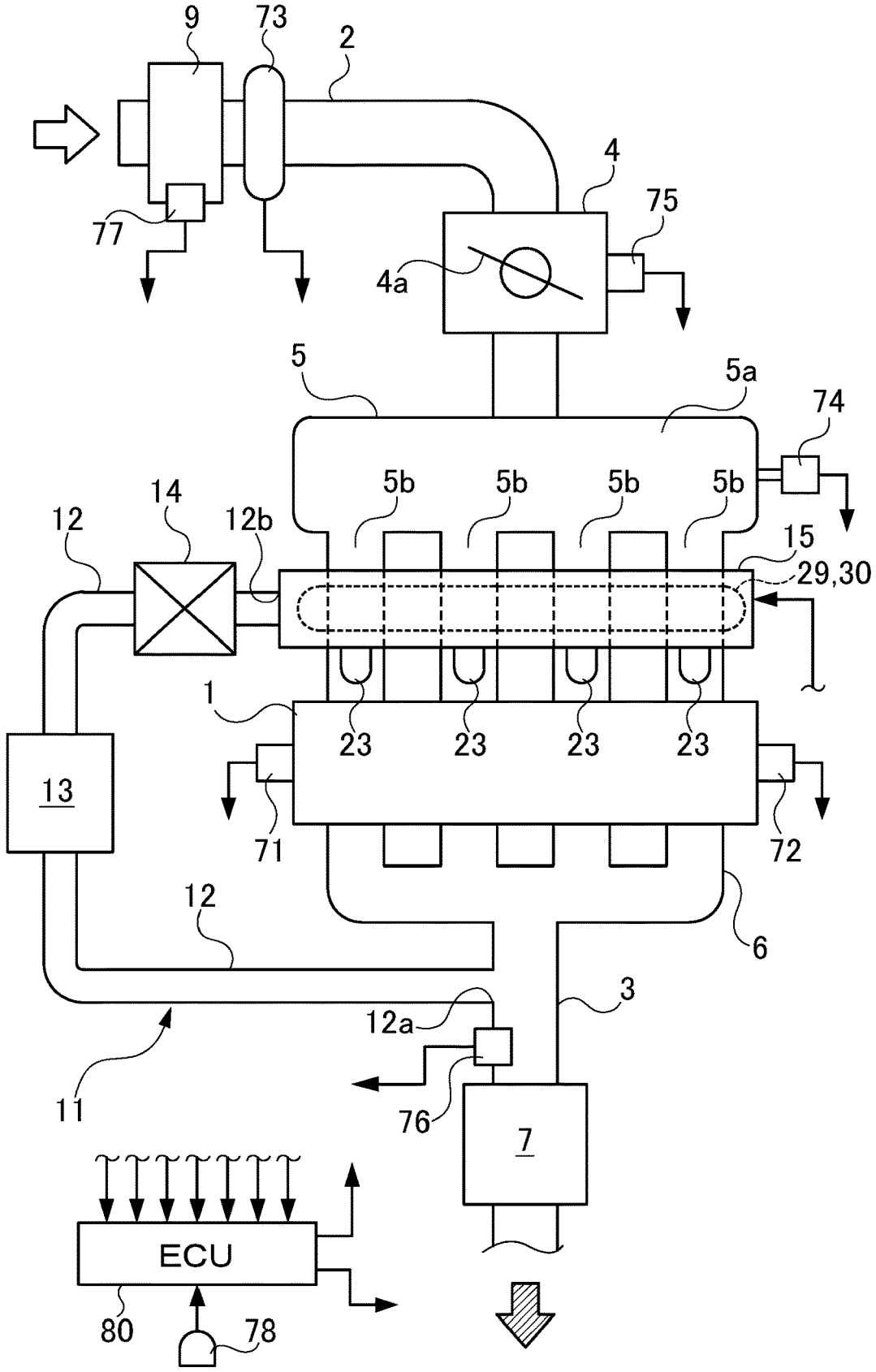
FIG. 1 is a schematic configuration view of an engine system in a first embodiment.

FIG. 1 is a schematic configuration view of a gasoline engine system (hereinafter, simply referred to as an engine system) in the present embodiment. This engine system which is mounted in an automobile includes an engine 1 having a plurality of cylinders. This engine 1 is a 4-cylinder, 4-cycle reciprocating engine, which includes well-known components, such as pistons, crankshafts, and others. The engine 1 is provided with an intake passage 2 for introducing intake air to the cylinders and an exhaust passage 3 for discharging exhaust gas from the cylinders of the engine 1. In the intake passage 2, there are provided an air cleaner 9, a throttle device 4, and an intake manifold 5, which are arranged in this order from an upstream side. In addition, this engine system includes a high-pressure loop exhaust gas recirculation device (an EGR device) 11.

The throttle device 4 is placed in the intake passage 2 upstream of the intake manifold 5 and configured to drive a butterfly throttle valve 4*a* to open and close at a variable opening degree in response to the operation of an accelerator by a driver in order to adjust the amount of intake air flowing through the intake passage 2. The intake manifold 5 is mainly made of resin material and placed on the intake passage 2 just upstream of the engine 1. This intake manifold 5 includes a single surge tank 5*a* into which intake air is introduced and a plurality of (four) branch pipes 5*b* branched off from the surge tank 5*a* to distribute the intake air introduced in the surge tank 5*a* to each cylinder of the engine 1. In the exhaust passage 3, there are provided an exhaust manifold 6 and a catalyst 7 in this order from an upstream side. The catalyst 7 contains for example a three-way catalyst to purify exhaust gas.

The engine 1 is provided with fuel injection devices (not shown) configured to inject fuel in one-to-one correspondence with the cylinders. The fuel injection devices are configured to inject the fuel supplied from a fuel supply device (not shown) to the corresponding cylinders of the engine 1. In each of the cylinders, the fuel injected from the fuel injection device and the intake air introduced from the intake manifold 5 are mixed, forming a combustible air-fuel mixture.

The engine 1 is further provided with ignition devices (not shown) in one-to-one correspondence with the cylinders. The ignition devices are configured to ignite the combustible air-fuel mixture generated in the corresponding cylinders. The combustible air-fuel mixture in each cylinder is exploded and burnt by an igniting action of the ignition devices. The exhaust gas after burning is discharged to the outside through each cylinder, the exhaust manifold 6, and the catalyst 7. At that time, a piston (not shown) in each cylinder moves up and down, thereby rotating a crankshaft (not shown), generating power in the engine 1.

(EGR System)

This EGR system in the present embodiment is provided with an EGR device 11. The EGR device 11 is configured to allow part of exhaust gas discharged from each cylinder of the engine 1 to the exhaust passage 3 to flow as an exhaust gas recirculation gas (EGR gas) to the intake passage 2 to return to each cylinder of the engine 1. The EGR device 11 includes an exhaust gas recirculation passage (an EGR passage) 12 configured to flow EGR gas from the exhaust passage 3 to the intake passage 2, an exhaust gas recirculation cooler (an EGR cooler) 13 configured to cool EGR gas that flows through the EGR passage 12, an exhaust gas recirculation valve (an EGR valve) 14 configured to adjust the amount of EGR gas flowing through the EGR passage 12, and an exhaust gas recirculation gas distributor (an EGR gas distributor) 15 configured to distribute EGR gas to each of branch pipes 5*b* of the intake manifold 5 in order to distribute EGR gas flowing through the EGR passage 12 to each of the cylinders of the engine 1. The EGR passage 12 includes an inlet 12*a* and an outlet 12*b*. The inlet 12*a* of the EGR passage 12 is connected to the exhaust passage 3 upstream of the catalyst 7, while the outlet 12*b* of the EGR passage 12 is connected to the EGR gas distributor 15. In the present embodiment, the EGR gas distributor 15 constitutes a final stage of the EGR passage 12. In this EGR passage 12, the EGR valve 14 is provided downstream of the EGR cooler 13 and the EGR gas distributor 15 is placed downstream of the EGR valve 14.

In this EGR device 11, when the EGR valve 14 is opened, a part of the exhaust gas flowing through the exhaust passage 3 is allowed to flow, as EGR gas, into the EGR passage 12 and is distributed to each branch pipe 5*b* of the intake manifold 5 through the EGR valve 14 and the EGR gas distributor 15, and further distributed to each cylinder of the engine 1 for recirculation.

(EGR Gas Distributor)

Figure 2:
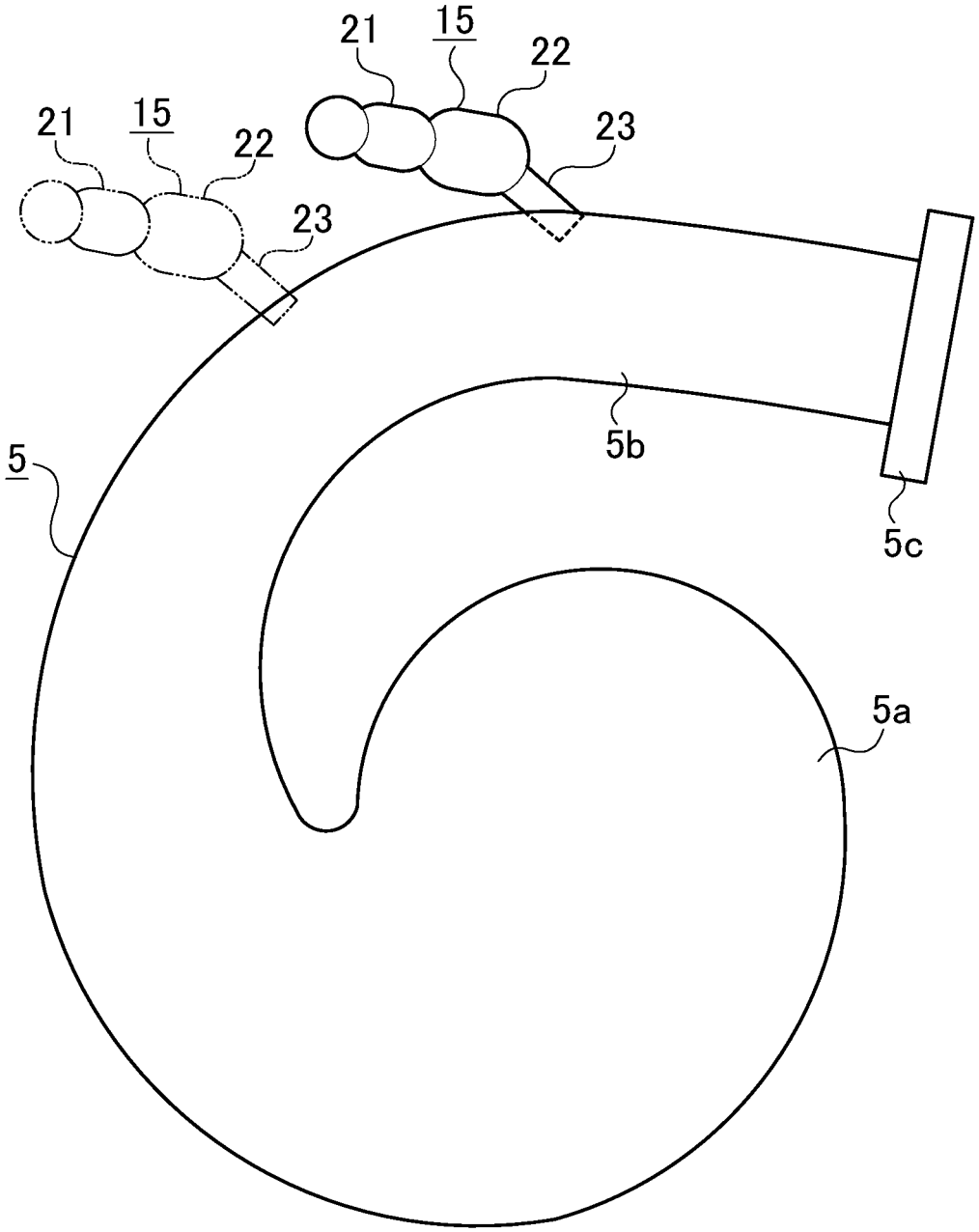
FIG. 2 is a schematic side view of an intake manifold provided with an EGR gas distributor in the first embodiment.

FIG. 2 is a schematic side view of the intake manifold 5 provided with the EGR gas distributor 15. The posture of the intake manifold 5 illustrated in FIG. 2 indicates the state of the intake manifold 5 when attached to the engine 1 in a vehicle so that the top and the bottom of the intake manifold 5 are oriented as shown in FIG. 2. The intake manifold 5 includes, in addition to the surge tank 5*a* and the plurality of branch pipes 5*b* (only one is shown), an outlet flange 5*c* for connection of outlets of the branch pipes 5*b* to the engine 1. In the present embodiment, the EGR gas distributor 15 is provided on the branch pipes 5*b* at positions close to the uppermost portions of the branch pipes 5*b* to distribute EGR gas to each branch pipe 5*b*.

Figure 3:
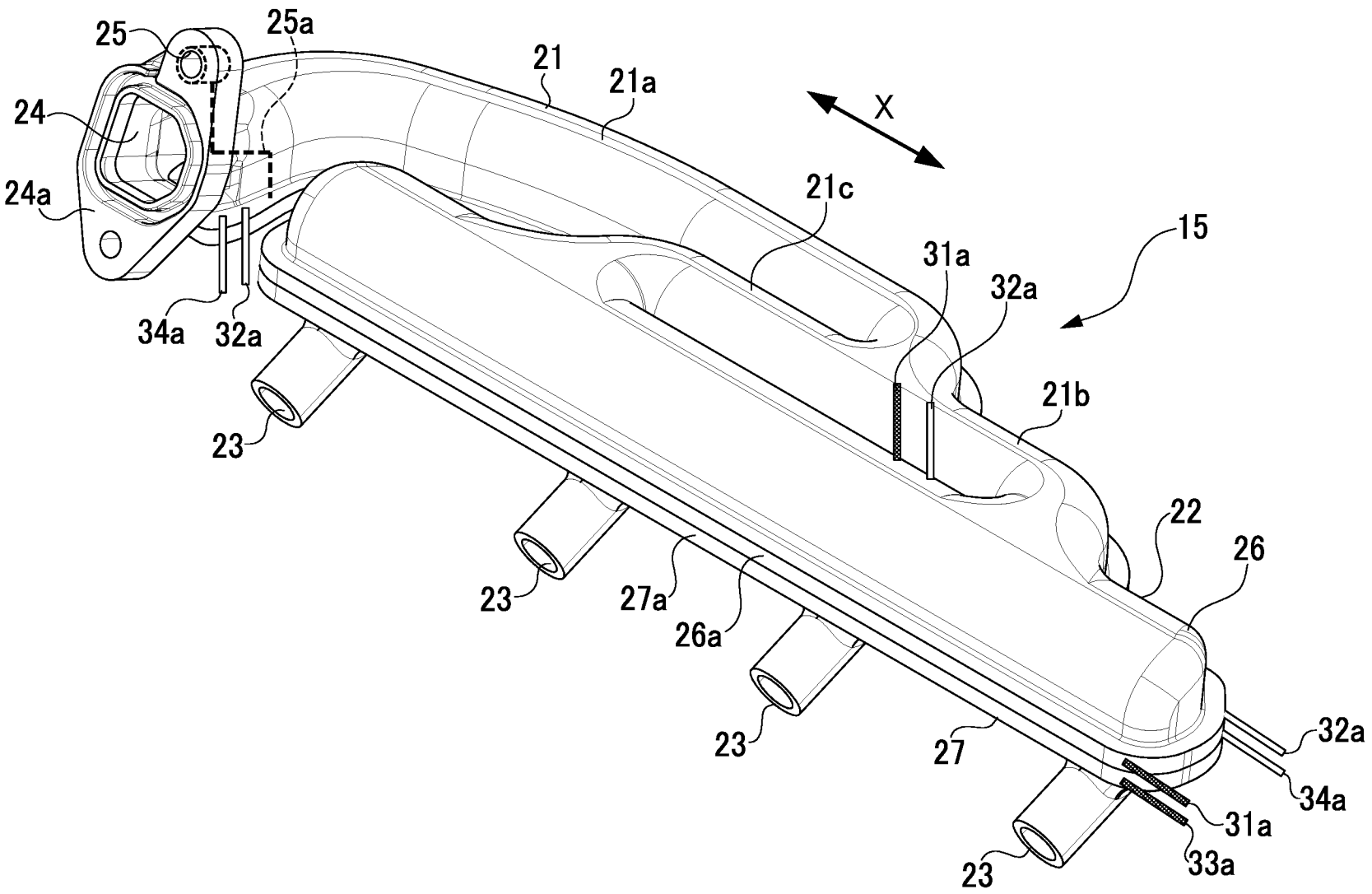
FIG. 3 is a perspective view of the EGR gas distributor seen from the front in the first embodiment.
Figure 4:
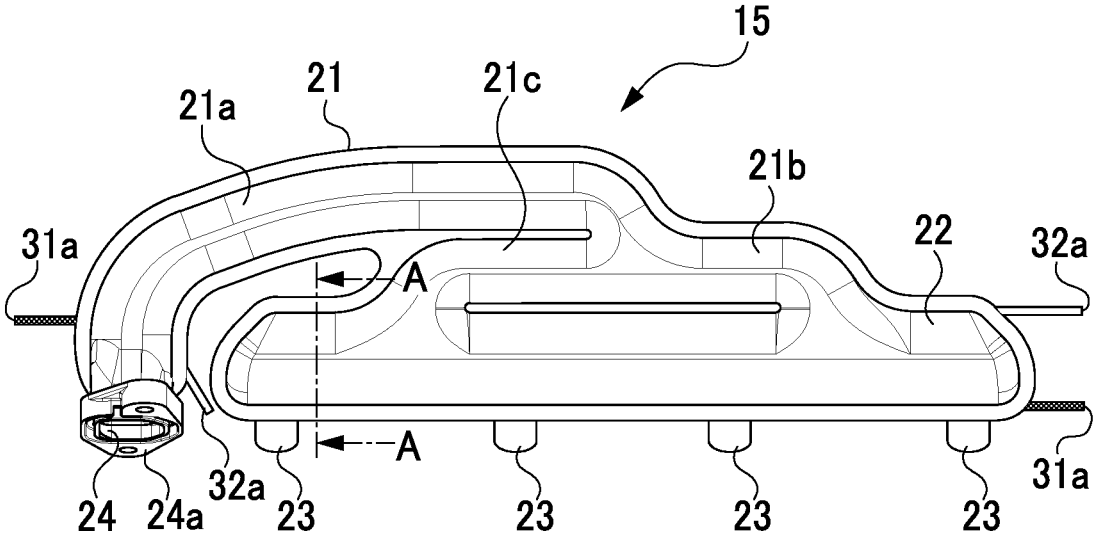
FIG. 4 is a plan view of the EGR gas distributor in the first embodiment.
Figure 5:
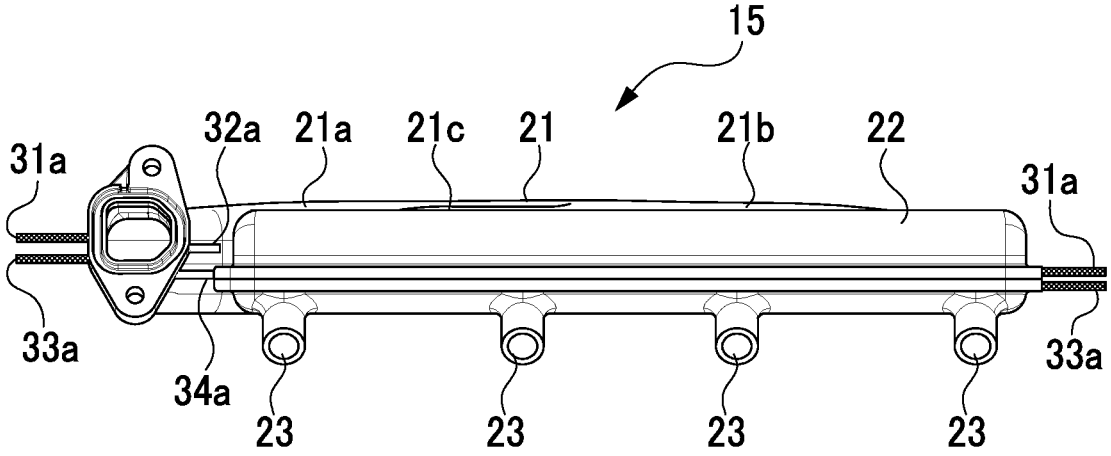
FIG. 5 is a front view of the EGR gas distributor in the first embodiment.
Figure 6:
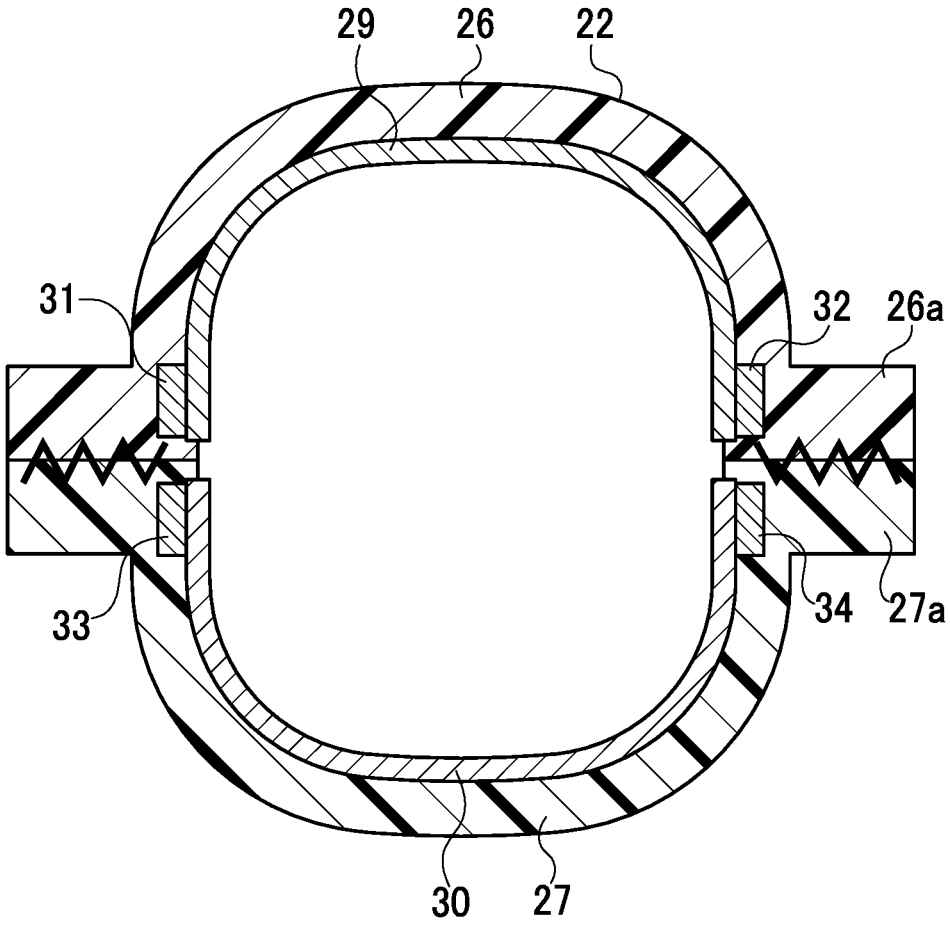
FIG. 6 is a cross-sectional view of a gas chamber of the EGR gas distributor, taken along a line A-A in FIG. 4, in the first embodiment.

FIG. 3 is a perspective view of the EGR gas distributor 15 seen from the front. FIG. 4 is a plan view of the EGR gas distributor 15. FIG. 5 is a front view of the EGR gas distributor 15. FIG. 6 is a cross-sectional view of a gas chamber 22 of the EGR gas distributor 15, taken along a line A-A in FIG. 4. The outer appearances and constructions of the intake manifold 5 and the EGR gas distributor 15 shown in FIGS. 2 to 5 are mere examples of the present disclosure. As shown in FIGS. 3 to 5, the EGR gas distributor 15 is mainly made of resin material and has a laterally long shape and is placed to extend across the plurality of branch pipes 5*b* of the intake manifold 5 in a longitudinal direction X (see FIG. 3) of the EGR gas distributor 15. The EGR gas distributor 15 is produced in advance separately from the intake manifold 5 and thereafter retrofitted onto the intake manifold 5. The EGR gas distributor 15 in the present embodiment mainly includes three parts, that is, a gas inflow passage 21 configured to allow EGR gas to be introduced therein, a single gas chamber 22 configured to collect EGR gas introduced into the gas inflow passage 21 (the inner diameter of the gas chamber 22 is larger than the inner diameter of the gas inflow passage 21), and a plurality of (four) gas distribution passages 23 branched off from the gas chamber 22 to distribute EGR gas from the gas chamber 22 to the corresponding branch pipes 5*b* (the inner diameter of each gas distribution passage 23 is smaller than the inner diameter of each of the gas inflow passage 21 and the gas chamber 22). The gas inflow passage 21 and the gas chamber 22 constitute one example of a gas passage in the present disclosure.

The gas inflow passage 21 has a gas inlet 24 through which EGR gas is introduced in this passage 21. The gas inlet 24 is connected with the EGR passage 12. For this connection with the EGR passage 12, an inlet flange 24*a* is provided around the gas inlet 24. The gas inflow passage 21 includes a passage part 21*a* extending from the gas inlet 24 and branch passage parts 21*b* and 21*c* branched off in a bifurcated shape from the passage part 21*a*. The gas inlet 24 opens on the front side of the EGR gas distributor 15. The passage part 21*a* extends in a curve from the front side to the back side of the EGR gas distributor 15 and joins to each of the branch passage parts 21*b* and 21*c*. The gas chamber 22 has a tubular, laterally long shape. The gas chamber 22 serves to collect EGR gas introduced into the gas inflow passage 21 through the gas inlet 24. The plurality of gas distribution passages 23 branch off from the gas chamber 22 in the front of the gas chamber 22. In the present embodiment, each of the gas distribution passages 23 extends at a slant obliquely downward from the gas chamber 22 to each corresponding branch pipe 5*b* and opens therein.

In the present embodiment, as shown in FIG. 6, the EGR gas distributor 15 is constituted of two members; an upper casing 26 and a lower casing 27. The upper casing 26 has an upper flange 26*a* formed over the outer circumference of the upper casing 26. The lower casing 27 has a lower flange 27*a* formed over the outer circumference of the lower casing 27. The upper casing 26 and the lower casing 27 are integrally joined by welding of the upper flange 26*a* and the lower flange 27*a*, constituting the EGR gas distributor 15.

In the present embodiment, as shown in FIG. 6, the EGR gas distributor 15 is provided, on its inner wall, with heating films (heat-generation films or coatings) 29 and 30. Specifically, an upper heating film 29 is provided on the inner wall of a part of the upper casing 26 that forms the gas chamber 22, and a lower heating film 30 is provided on the inner wall of a part of the lower casing 27 that forms the gas chamber 22. Further, on both ends of the upper heating film 29 in its width direction (a lateral direction in FIG. 6), a pair of an upper positive electrode 31 and an upper negative electrode 32 is provided between the inner wall of the upper casing 26 and the upper heating film 29 to energize the upper heating film 29. On both ends of the lower heating film 30 in its width direction, a pair of a lower positive electrode 33 and a lower negative electrode 34 is provided between the inner wall of the lower casing 27 and the lower heating film 30 to energize the lower heating film 30. In the present embodiment, the upper heating film 29 and the lower heating film 30 have the same thickness and are provided to cover almost the entire inner walls of the part of the upper casing 26 and the part of the lower casing 27, the parts forming the gas chamber 22. In the present embodiment, even though it is not illustrated, the inner walls of a part of the upper casing 26 and a part of the lower casing 27, the parts forming the gas inflow passage 21, are also provided with the upper heating film 29 and the lower heating film 30, the upper positive electrodes 31 and the upper negative electrodes 32, and the lower positive electrodes 33 and the lower negative electrodes 34 as with the inner walls of the gas chamber 22. Furthermore, as shown in FIGS. 3 to 5, in the EGR gas distributor 15, an upper positive terminal 31*a* and an upper negative terminal 32*a*, and a lower positive terminal 33*a* and a lower negative terminal 34*a*, respectively extending from the positive electrodes 31 and 33 and the negative electrodes 32 and 34, are provided in each of an upstream end part (near the inlet flange 24*a*) and a downstream end part (the branch passage part 21*b*) of the gas inflow passage 21 and one end portion and a middle portion of the gas chamber 22. Each of the heating films 29 and 30 is energized through those terminals 31*a*, 32*a*, 33*a*, and 34*a* via respective electrodes 31, 32, 33, and 34, so that each heating film 29 and 30 generates heat, thereby heating the inner walls of the gas inflow passage 21 and the gas chamber 22 of the EGR gas distributor 15.

Figure 7:
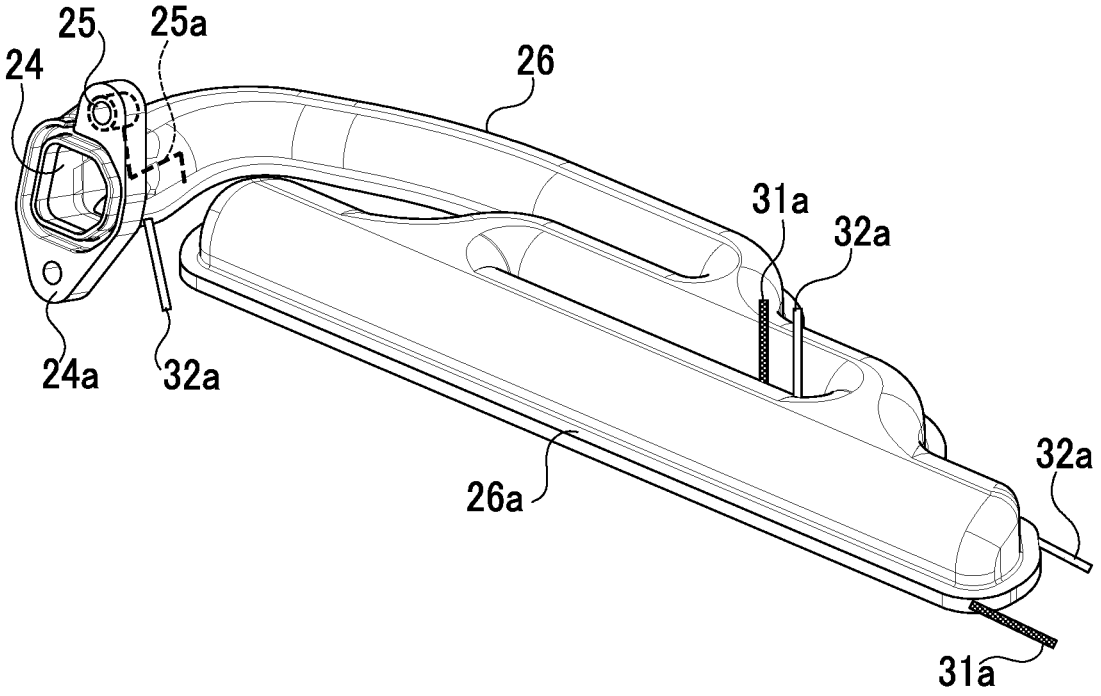
FIG. 7 is a perspective view showing the outside of an upper casing in the first embodiment.
Figure 8:
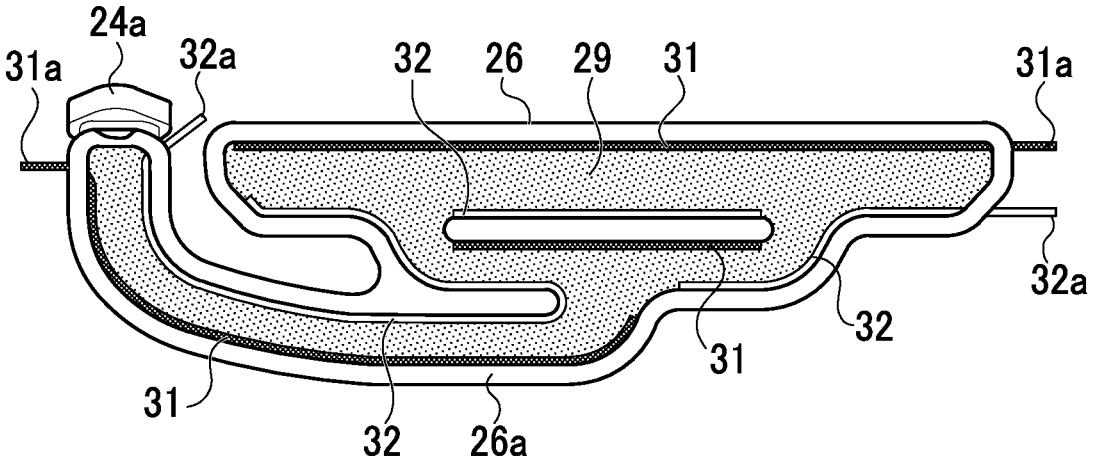
FIG. 8 is a plan view showing the inside of the upper casing in the first embodiment.
Figure 9:
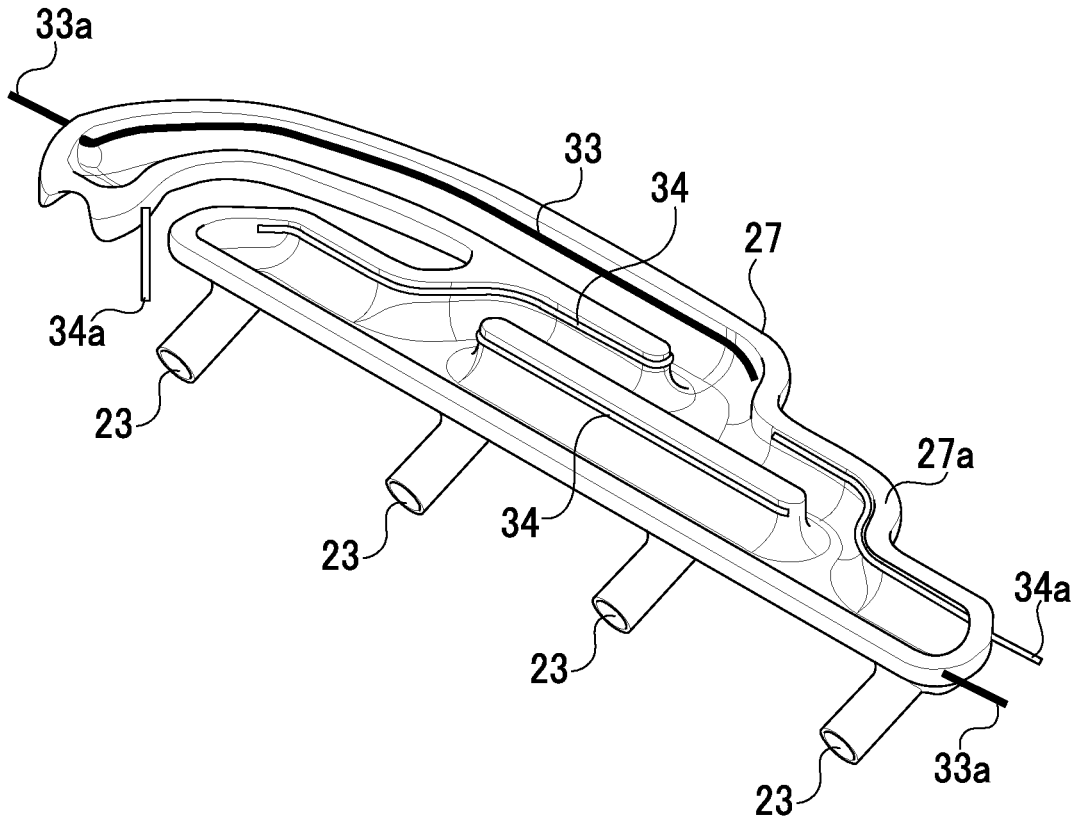
FIG. 9 is a perspective view showing the inside of a lower casing in the first embodiment.
Figure 10:
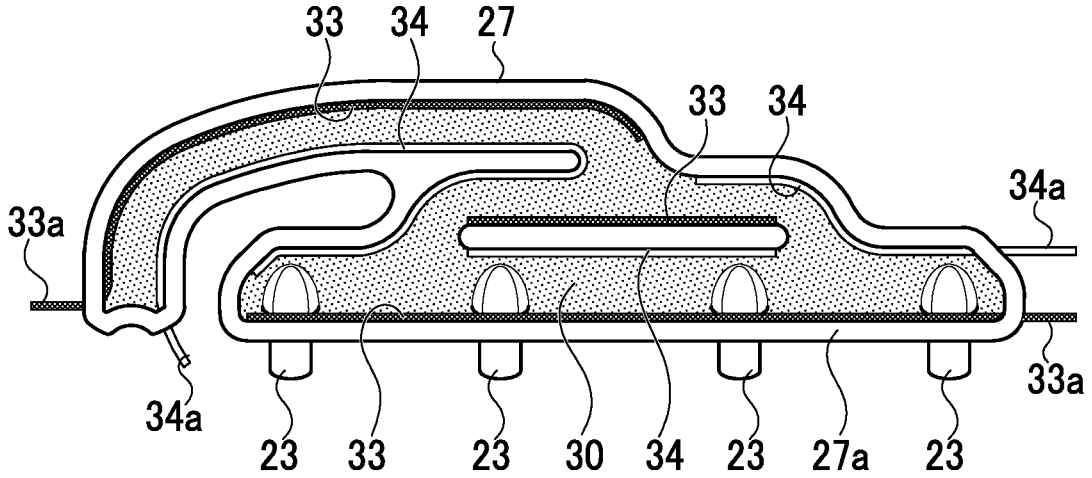
FIG. 10 is a plan view showing the inside of the lower casing in the first embodiment.

FIG. 7 is a perspective view showing the outside of the upper casing 26. FIG. 8 is a plan view showing the inside of the upper casing 26. FIG. 9 is a perspective view showing the inside of the lower casing 27. FIG. 10 is a plan view showing the inside of the lower casing 27. As shown in FIG. 8, the upper positive electrodes 31 (illustrated by a black solid line) and the upper negative electrodes 32 (illustrated by a hollow line) are provided on the inner wall of the upper casing 26 along the upper flange 26*a* so that they are opposed to each other. The upper heating film 29 as hatched with dots in FIG. 8 is provided between the opposed upper positive electrode 31 and upper negative electrode 32 so as to cover almost the entire surface of the inner wall of the upper casing 26. As shown in FIGS. 9 and 10, the lower positive electrodes 33 (illustrated by a black solid line) and the lower negative electrodes 34 (illustrated by a hollow line) are provided on the inner wall of the lower casing 27 along the lower flange 27*a*. The lower heating film 30 as hatched with dots in FIG. 10 is provided between the opposed lower positive electrode 33 and lower negative electrode 34 so as to cover almost the entire surface of the inner wall of the lower casing 27.

Each of the heating films 29 and 30 is provided with a ground wire. In this embodiment, the EGR gas distributor 15 is connected, i.e., attached, to the EGR passage 12 through the inlet flange 24*a*. As shown in FIG. 3, the inlet flange 24*a* is provided with a metal collar 25 having electric conductivity in a bolt hole. To this metal collar 25, a ground wire of each heating film 29 and 30 is connected. The inlet flange 24*a* is connected to a flange provided on an upstream side of the EGR passage 12 with a bolt inserted in the metal collar 25. In this case, the upstream side of the EGR passage 12 is connected to a vehicle through a conductive metal member and is grounded. Thus, connection of the inlet flange 24*a* to the flange of the EGR passage 12 enables to make a ground for the heating films 29 and 30.

(Heating Films)

Herein, the heating films 29 and 30 will be described in detail. As the heating films 29 and 30, for example, "Heating film coating" made by Toyo Drilube Co., Ltd. can be used. This heating film is a drying film made by mixing and dispersing various kinds of conductive pigments in a special binder, and can generate heat over the entire film when supplied with electric power through electrodes. Electric currents applied to the mixed conductive pigment (conductor) is converted into heat energy (Joule heat) to obtain a heating efficiency. The characteristics of this heating film are as below:

(1) It can develop the heating property with low voltage;
(2) It generates heat from the entire surface and thus can generate heat more uniformly as compared with nichrome wire;
(3) It can be thinned in thickness and reduced in weight;
(4) It has superior flexibility and can be made in a film shape; and
(5) It can provide arbitrary heating property by adjustment of a coated film thickness, an electrode length, an inter-electrode distance (i.e., a distance between electrodes), and others.

(Electrical Configuration of the Engine System)

One example of the electrical configuration of the engine system will be described below. In FIG. 1, various sensors 71 to 78 provided in this engine system constitute an operating state detecting unit for detecting an operating state of the engine 1. A water temperature sensor 71 provided in the engine 1 detects a temperature of cooling water that flows through the inside of the engine 1, namely, a cooling water temperature THW, and outputs an electric signal representing a detected value. A rotation speed sensor 72 provided in the engine 1 detects a rotation angle of a crank shaft, i.e., a crank angle, of the engine 1 and also detects a change in crank angle, i.e., a crank angle speed, as a rotation speed NE of the engine 1 (an engine rotation speed), and outputs an electric signal representing a detected value. An air flow meter 73 provided near the air cleaner 9 detects an intake amount Ga of intake air that flows through the air cleaner 9 and outputs an electric signal representing a detected value. An intake pressure sensor 74 provided on the surge tank 5*a* detects an intake pressure PM in the intake passage 2 downstream of the throttle device 4, namely, in the surge tank 5*a*, and outputs an electric signal representing a detected value. A throttle sensor 75 provided on the throttle device 4 detects an opening degree TA of the throttle valve 4*a* (a throttle opening degree) and outputs an electric signal representing a detected value. An oxygen sensor 76 provided in the exhaust passage 3 between the inlet 12*a* of the EGR passage 12 and the catalyst 7 detects an oxygen concentration Ox of exhaust gas and outputs an electric signal representing a detected value. An intake temperature sensor 77 provided in an inlet of the air cleaner 9 detects a temperature of outside air sucked into the air cleaner 9, namely, an intake temperature THA, and outputs an electric signal representing a detected value. An ignition switch (an IG switch) 78 provided at a driver's seat detects start or stop of the engine 1 by operation of a driver and outputs a detection signal. In the present embodiment, the water temperature sensor 71 and the intake temperature sensor 77 correspond to one example of a warm-up state detecting unit in the present disclosure configured to respectively detect the cooling water temperature THW and the intake temperature THA as parameters indicating a warm-up state of the EGR passage 12 (including the EGR gas distributor 15) and a warm-up state of the intake passage 2.

The above-configured engine system further includes an electronic control unit (ECU) 80 for controlling this system. The ECU 80 is connected to each of the various sensors and others 71 to 78. The ECU 80 is further connected to an injector (not shown) and an ignition coil (not shown) in addition to the EGR valve 14 and each of the heating films 29 and 30 of the EGR gas distributor 15. The ECU 80 corresponds to one example of an energization control unit and an EGR control unit in the present disclosure. The ECU 80 is provided, as well known, with a central processing unit (CPU), various memories, an external input circuit, an external output circuit, and others. The memories store predetermined control programs related to various controls of the engine system. The CPU is configured to execute fuel injection control, ignition timing control, EGR control, and energization control of each heating film 29 and 30 according to the predetermined control programs based on detection signals from the various sensors and others 71 to 78 which are transmitted to the CPU through the input circuits.

In the present embodiment, in the EGR control, the ECU 80 is configured to control the EGR valve 14 according to the operating state of the engine 1. To be specific, the ECU 80 controls the EGR valve 14 to fully close during stop, idle, and deceleration of the engine 1. During other operations, the ECU 80 obtains a target EGR opening degree according to the operating state and controls the EGR valve 14 to open at the target EGR opening degree. At that time, when the EGR valve 14 is opened, exhaust gas is discharged from the engine 1 to the exhaust passage 3 and, a part of the exhaust gas is allowed to flow as EGR gas into the intake passage 2 (the intake manifold 5) through the EGR passage 12, the EGR cooler 13, the EGR valve 14, the EGR gas distributor 15, and others to return to each cylinder of the engine 1. In the EGR control, furthermore, the ECU 80 is configured to start EGR when the cooling water temperature THW becomes a predetermined EGR start water temperature after startup of the engine 1.

(First Energization Control of Heating Films)

Figure 11:
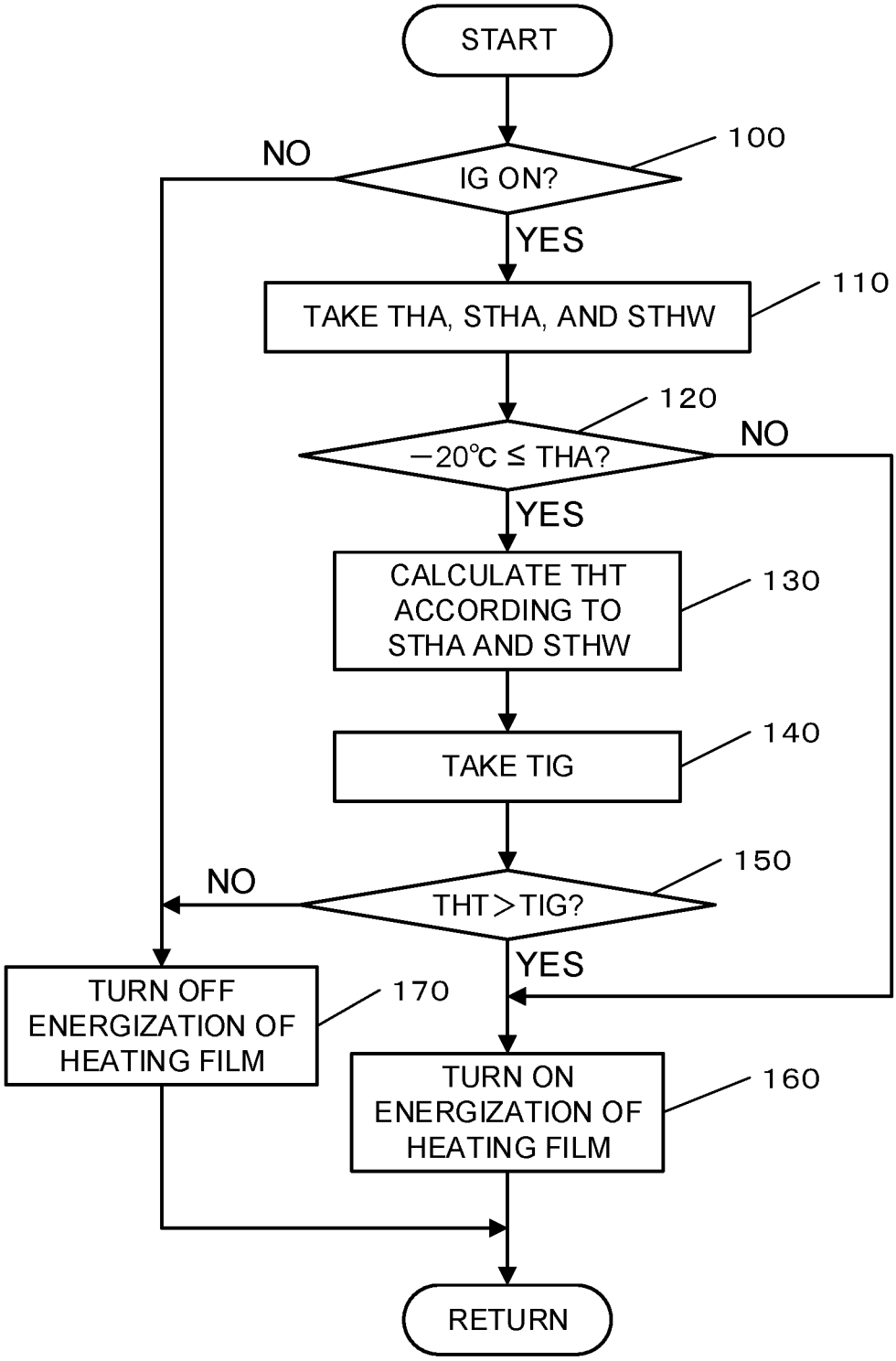
FIG. 11 is a flowchart showing the contents of first energization control in the first embodiment.

Herein, the first energization control of each heating film 29 and 30 of the EGR gas distributor 15 will be described below. FIG. 11 is a flowchart showing the contents of this energization control.

When the processing shifts to this routine, in step 100, the ECU 80 determines whether or not ignition (IG) is turned on (IG-ON), that is, the engine 1 has started a startup operation, based on the detection signal transmitted from the IG switch 78. When this determination result is affirmative (YES), the ECU 80 shifts the processing to step 110. When this determination result is negative (NO), the ECU 80 shifts the processing to step 170.

In step 110, the ECU 80 individually takes an intake temperature THA, an intake temperature at engine startup, that is, when IG is turned on, namely, an at-startup intake temperature STHA, and a cooling water temperature at engine startup, namely, an at-startup cooling water temperature STHW, based on the detected values of the water temperature sensor 71 and the intake temperature sensor 77.

In step 120, the ECU 80 then determines whether or not the intake temperature THA is equal to or larger than −20° C. This value −20° C. is one example of a criterion for determination. When this determination result is YES, the ECU 80 advances the processing to step 130. When this determination result is NO, the ECU 80 shifts the processing to step 160.

In step 130, the ECU 80 calculates an energization time THT (unit: seconds) required for each heating film 29 and 30 (a required energization time) according to the at-startup intake temperature STHA and the at-startup cooling water temperature STHW. The ECU 80 can obtain the required energization time THT according to the at-startup intake temperature STHA and the at-startup cooling water temperature STHW by referring to for example a required energization time map as shown in FIG. 12. In this map, the required energization time THT is set longer as each of the at-startup intake temperature STHA and the at-startup cooling water temperature STHW is lower. In this map, furthermore, when the at-startup intake temperature STHA is equal to or lower than a predetermined value (−20° C.), energization of each heating film 29 and 30 is set to be always kept ON.

In step 140, the ECU 80 subsequently takes an elapsed time (post IG-ON time) TIG, counting of which is started from IG-ON.

In step 150, the ECU 80 determines whether or not the post IG-ON time reaches the required energization time THT. When this determination result is YES, the ECU 80 advances the processing to step 160. When this determination result is NO, the ECU 80 shifts the processing to step 170.

In step 160 following step 120 or step 150, the ECU 80 turns on energization of each of the heating films 29 and 30 to heat the EGR gas distributor 15. Thereafter, the ECU 80 returns the processing to step 100.

On the other hand, in step 170 following step 100 or step 150, the ECU 80 turns off energization of each of the heating films 29 and 30 to stop heating the EGR gas distributor 15. Thereafter, the ECU 80 returns the processing to step 100.

According to the above-described first energization control, the ECU 80 is configured to control energization of each heating film 29 and 30 based on a warm-up state of the intake passage 2 and a warm-up state of the EGR passage 12 (including the EGR gas distributor 15) from before EGR is started. Herein, for energization of each heating film 29 and 30, the ECU 80 is configured to control an energization time to energize each heating film 29 and 30 based on the above-mentioned warm-up states at startup of the engine 1. To be concrete, when the intake temperature THA is lower than −20° C. after IG-ON, the ECU 80 is configured to keep each heating film 29 and 30 in an always-ON state, that is, an energized state. In contrast, when the intake temperature THQ is −20° C. or higher after IG-ON, the ECU 80 is configured to continue energization of each heating film 29 and 30 until a predetermined required energization time THT elapses from IG-ON. The ECU 80 is further configured to set a required energization time THT according to the at-startup intake temperature STHA and the at-startup cooling water temperature STHW. For details, the ECU 80 is configured to set the required energization time THT longer as the at-startup intake temperature STHA and the at-startup cooling water temperature STHW are lower.

(Behaviors of Various Parameters During Execution of the First Energization Control)

Figure 13:
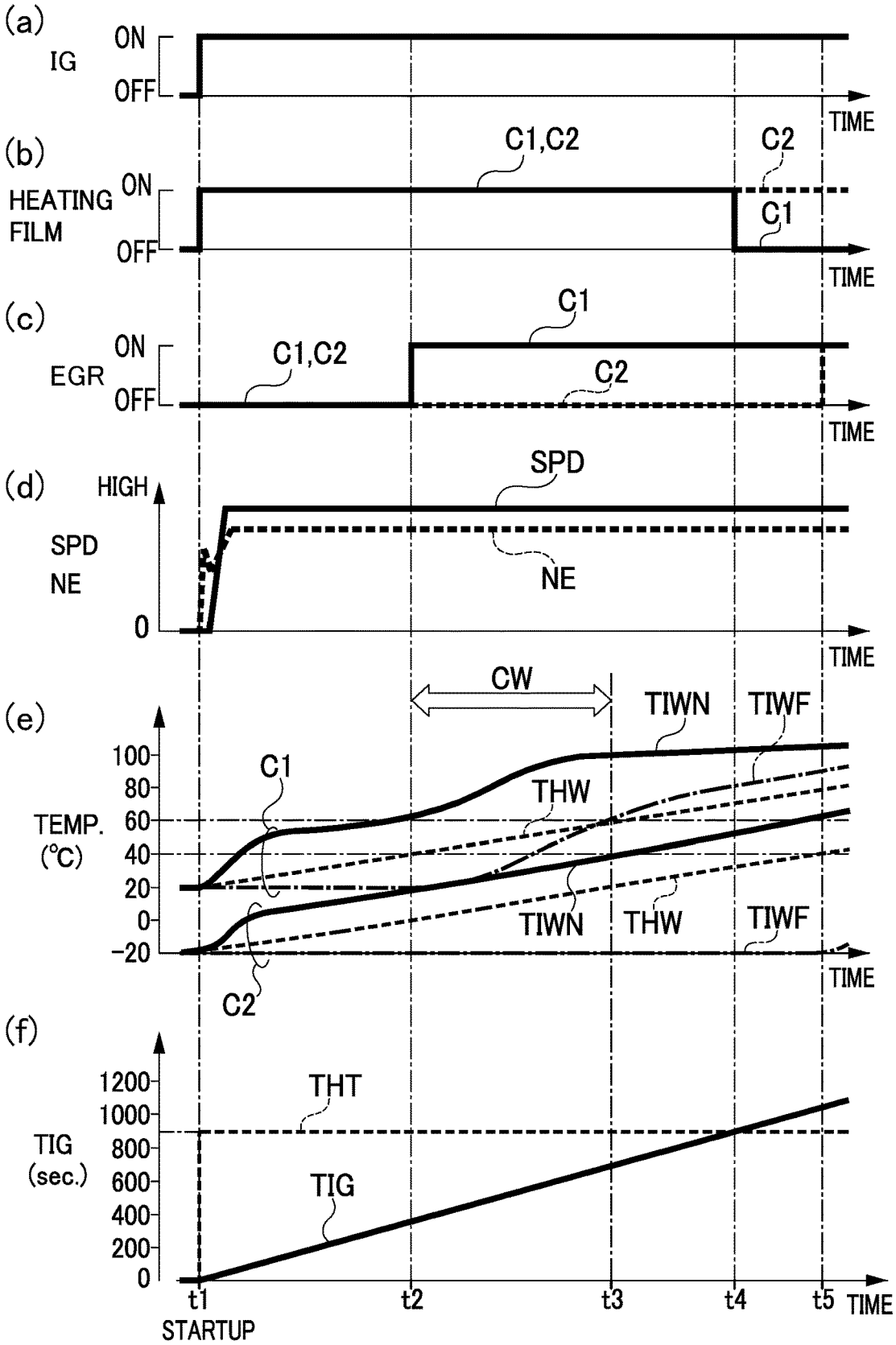
FIG. 13 is a time chart showing behaviors of various parameters during execution of the first energization control in the first embodiment.

Herein, the behaviors of various parameters during execution of the foregoing first energization control will be described with reference to a time chart shown in FIG. 13. In FIG. 13, (a) shows IG turn-on (ON) and IG turn-off (OFF), (b) shows ON and OFF of energization of each heating film 29 and 30, (c) shows ON and OFF of EGR, (d) shows changes in vehicle speed SPD (a solid line) and an engine rotation speed NE (a broken line), (e) shows changes in various temperatures, and (f) shows changes in post IG-ON time TIG. In the present embodiment, the cooling water temperature THW for starting EGR is set to 40° C., not to a dew-point temperature of 60° C.

In FIG. 13 (*e*), the first case C1 shows that the at-startup intake temperature STHA and the at-startup cooling water temperature STHW are 20° C., in which a solid line indicates changes in inner wall temperature TIWN of the EGR gas distributor 15 when energization of each heating film 29 and 30 is turned on, a broken line indicates changes in cooling water temperature THW, a one-dot chain line indicates changes in inner wall temperature TIWF of the EGR gas distributor 15 when energization of each heating film 29 and 30 is turned off. The second case C2 shows that the at-startup intake temperature STHA and the at-startup cooling water temperature STHW are −20° C., in which a solid line indicates changes in inner wall temperature TIWN of the EGR gas distributor 15 when energization of each heating film 29 and 30 is turned on, a broken line indicates changes in cooling water temperature THW, a one-dot chain line indicates changes in inner wall temperature TIWF of the EGR gas distributor 15 when energization of each heating film 29 and 30 is turned off.

In FIG. 13 (*f*), a solid line indicates changes in post IG-ON time TIG and a broken line indicates the required energization time THT in the first case C1.

As shown in FIG. 13, when (a) IG is turned on (engine startup) at time t1, (b) energization of each heating film 29 and 30 is turned on (start of heating), (d) the engine rotation speed NE starts to increase and the vehicle speed SPD starts a little late to increase, and (f) the required energization time THT is set to 900 seconds and the post IG-ON time TIG starts to increase.

Subsequently, in the first case C1, at time t2, (e) the cooling water temperature THW reaches 40° C. and (c) the EGR is turned on (EGR is started). At time t4, when the post IG-ON time TIG reaches the required energization time THT (900 seconds), energization of each heating film 29 and 30 is stopped (Energization cutoff).

Herein, in the first case C1, (e) the inner wall temperature TIWN and the cooling water temperature THW start to increase at time t1, the inner wall temperature TIWN reaches the dew-point temperature (60° C.) at time t2, the cooling water temperature THW reaches the dew-point temperature at time t3, and then the inner wall temperature TIWN and the cooling water temperature THW both slowly increase until time t5.

In contrast, in the first case C1, if energization of each heating film 29 and 30 is not turned on, (e) the inner wall temperature TIWF starts to increase after time t2 by being heated by the heat of introduced EGR gas and reaches the dew-point temperature at time t3. Accordingly, if energization of each heating film 29 and 30 is not turned on, the generation of condensed water, i.e., condensed water generation CW, occurs in a period from time t2 to time t3. To prevent this condensed water generation CW, the ECU 80 has to wait the start of EGR until time t3. In the present embodiment, in the first case C1, energization of each heating film 29 and 30 is turned on at the same time as startup of the engine 1, i.e., from before start of EGR. Therefore, at relatively early time t2, even when the cooling water temperature THW reaches 40° C. and EGR is started, the inner wall temperature TIWN exceeds the dew-point temperature (60° C.) at that time and thus EGR can be started without generating condensed water in the EGR gas distributor 15.

In contrast, in the second case C2, (e) the inner wall temperature TIWN and the cooling water temperature THW start to increase at time t1, and then, both the temperatures TIWN and THW continue to increase and, at time t5, the inner wall temperature TIWN exceeds the dew-point temperature (60° C.), the cooling water temperature THW reaches 40° C., and EGR is turned on. Herein, if energization of each heating film 29 and 30 is not turned on, (e) the inner wall temperature TIWF would remain −20° C. until time t5 and start to increase after time t5 by being heated by the heat of introduced EGR gas. When EGR is turned on at time t5, consequently, the inner wall temperature TIWF has not reached the dew-point temperature (60° C.) and thus condensed water is generated. In the present embodiment, in the second case C2, energization of each heating film 29 and 30 is turned on at the same time as startup of the engine 1, i.e., from before EGR is started. Accordingly, even if the cooling water temperature THW reaches 40° C. and EGR is started at time t5, the inner wall temperature TIWN exceeds the dew-point temperature (60° C.) and thus EGR can be started without causing the generation of condensed water in the EGR gas distributor 15.

(Operations and Effects of the EGR System)

According to the EGR system configured as above in the present embodiment, EGR gas flowing through the EGR passage 12 is introduced into the gas inflow passage 21 of the EGR gas distributor 15, flows through the gas inflow passage 21 while branching off and collects in the gas chamber 22, and this EGR gas is appropriately distributed through the plurality of gas distribution passages 23 to each corresponding branch pipe 5*b* of the intake manifold 5, and then distributed to each cylinder of the engine 1 for recirculation.

In the present embodiment, the generation of condensed water is problematic for the EGR gas distributor 15 (the EGR passage). In the EGR gas distributor 15, however, when the heating films 29 and 30 are energized through the positive electrodes 31 and 33 and the negative electrodes 32 and 34, these heating films 29 and 30 generate heat, thereby heating the inner walls of the gas inflow passage 21 and the gas chamber 22. Thus, arbitrarily controlling the energization of the heating films 29 and 30 adjusts the temperature and the temperature rise of the inner walls of the gas inflow passage 21 and the gas chamber 22 provided with the heating films 29 and 30. This configuration can increase the temperature of the inner walls of the EGR gas distributor 15 (the EGR passage) with good responsivity and keep the temperature stable.

Herein, the ECU 80 is configured to control energization of each heating film 29 and 30 from before start of EGR based on the at-startup intake temperature STHA and the at-startup cooling water temperature STHW respectively detected by the intake temperature sensor 77 and the water temperature sensor 71, corresponding to the warm-up states of the intake passage 2 and the EGR passage 12 (including the EGR gas distributor 15). Accordingly, the temperature and the temperature rise of the inner walls of the EGR gas distributor 15 provided with the heating films 29 and 30 are adjusted from before start of EGR according to the at-startup intake temperature STHA and the at-startup cooling water temperature STHW. This configuration can increase the temperature of the inner walls of the EGR gas distributor 15 with good responsivity and accurately control the relevant temperature. Consequently, it is possible to prevent the generation of condensed water in the EGR gas distributor 15 when EGR is started.

According to the present embodiment configured as above, the energization time to energize each of the heating films 29 and 30 is adjusted according to the at-startup intake temperature STHA and the at-startup cooling water temperature STHW which correspond to the warm-up state of the EGR gas distributor 15 at startup of the engine 1. This configuration does not energize the heating films 29 and 30 more than necessary and therefore needless energization can be prevented.

According to the present embodiment configured as above, the negative electrodes 32 and 34 of the heating films 29 and 30 and the ground wire 25*a* are connected to the metal collar 25 provided in the inlet flange 24*a* (the joint) of the EGR gas distributor 15 (the EGR passage). Thus, the ground wire 25*a* does not need to be separately and independently grounded. This configuration can apply grounding to each of the heating films 29 and 30 without installing wiring outside the EGR gas distributor 15.

The present embodiment configured as above can prevent the generation of condensed water in the EGR gas distributor 15 as described above, so that the condensed water is less likely to flow from the EGR gas distributor 15 to each branch pipe 5*b*. This configuration can offer greater flexibility of placement to the EGR gas distributor 15 with respect to the intake manifold 5. For instance, the EGR gas distributor 15 can be placed on the intake manifold 5 (the branch pipes 5*b*) at a position far from the outlet flange 5*c* (the engine) as shown by a two-dot chain line in FIG. 2, which is away from the present position illustrated by a solid line in FIG. 2 (i.e., the position close to the outlet flange 5*c*). In this case, since the EGR gas distributor 15 is apart from the engine 1, it is possible to prevent adhesion and accumulation of deposits on distal ends of the gas distribution passages 23, and design the gas distribution passages 23 with a reduced inner diameter to suppress the attenuation of pulsation of intake air, thereby enabling to prevent lowering of engine power. Further, the open ends of the gas distribution passages 23 can be made flush with the inner walls of the branch pipes 5*b*, thus enabling to minimize the resistance of intake air flow.

Second Embodiment

Next, a second embodiment will be described in detail with reference to the accompanying drawings. In the following description, similar or identical components to those in the first embodiment are assigned the same reference signs as in the first embodiment and their details are omitted. The following description will be given with a focus on differences from the first embodiment.

(Second Energization Control of Heating Films)

Figure 14:
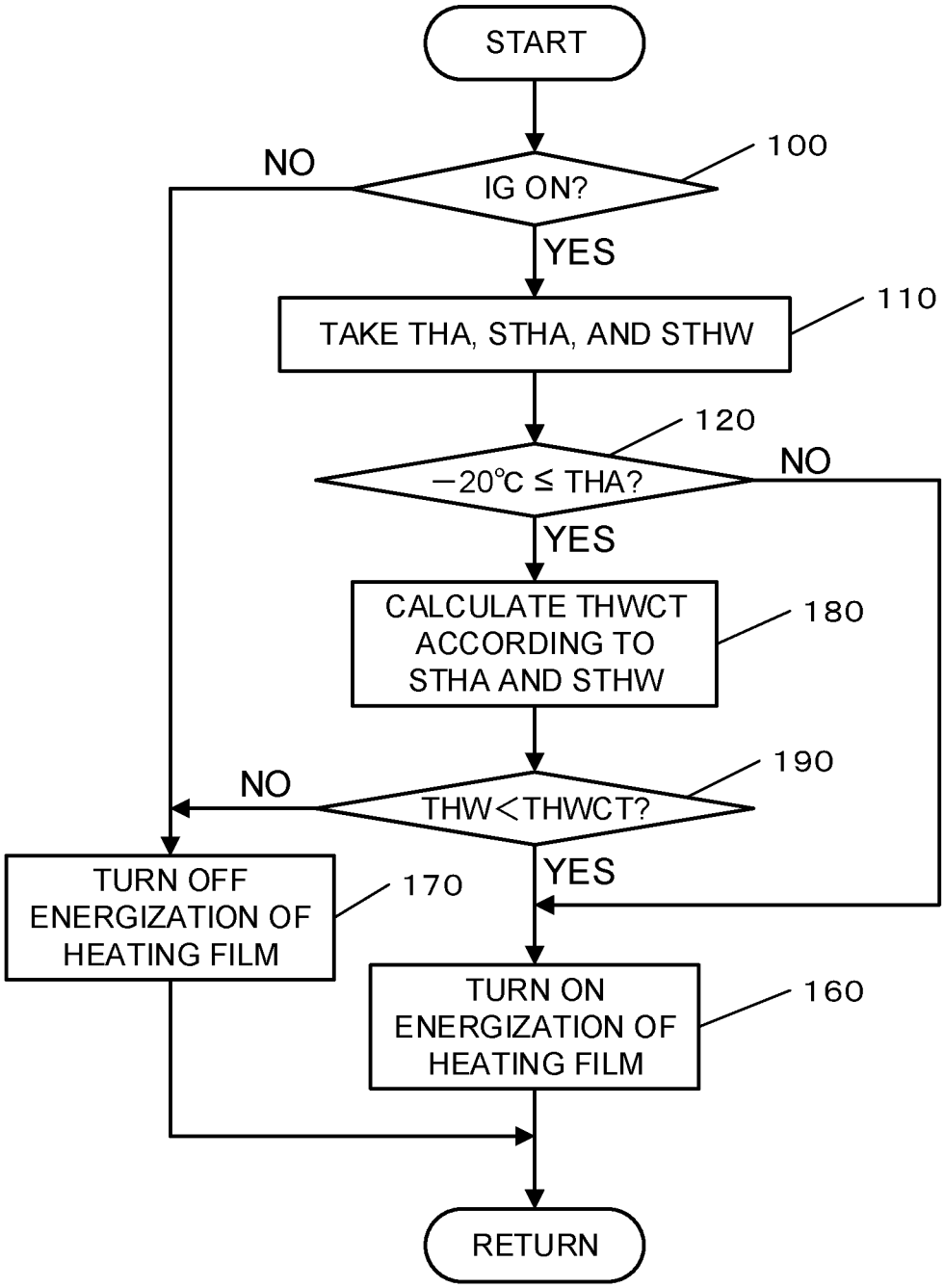
FIG. 14 is a flowchart shoring the contents of second energization control in a second embodiment.

This second embodiment differs from the first embodiment in the contents of the second energization control of the heating films 29 and 30. FIG. 14 is a flowchart showing the contents of the second energization control in the present embodiment. The flowchart in FIG. 14 differs from that in FIG. 11 in new steps 180 and 190 are provided instead of steps 130 to 150.

When the processing shifts to this routine, the ECU 80 executes the processing in steps 100 to 120 and, if the determination result in step 120 is YES, advances the processing to step 180.

In step 180, the ECU 80 calculates a cooling water temperature THWCT for cutting off energization of the heating films 29 and 30 (i.e., an energization-cutoff cooling water temperature) (unit: ° C.) after startup of the engine 1 according to the at-startup intake temperature STHA and the at-startup cooling water temperature STHW. The ECU 80 can obtain the energization-cutoff cooling water temperature THWCT according to the at-startup intake temperature STHA and the at-startup cooling water temperature STHW by referring to for example an energization-cutoff cooling water temperature map as shown in FIG. 15. In this map, the energization-cutoff cooling water temperature THWCT is set higher as each of the at-startup intake temperature STHA and the at-startup cooling water temperature STHW is lower. Further, in this map, when the at-startup intake temperature STHA is equal to or lower than a predetermined value (−20° C.), energization of each heating film 29 and 30 is set to be always kept ON.

In step 190, the ECU 80 successively determines whether or not the cooling water temperature THW is lower than the energization-cutoff cooling water temperature THWCT. When this determination result is YES, the ECU 80 advances the processing to step 160. When this determination result is NO, the ECU 80 shifts the processing to step 170. In other words, when the cooling water temperature THW is lower than the energization-cutoff cooling water temperature THWCT, the ECU 80 turns on energization of each heating film 29 and 30 in step 160. On the other hand, when the cooling water temperature THW is equal to or higher than the energization-cutoff cooling water temperature THWCT, the ECU 80 turns off energization of each heating film 29 and 30, i.e., cuts off the energization in step 170.

According to the second energization control described above, the ECU 80 is configured to control energization of each heating film 29 and 30 from before start of EGR based on the warm-up states of the intake passage 2 and the EGR passage 12 (including the EGR gas distributor 15). Herein, for energization of each heating film 29 and 30, the ECU 80 is configured to calculate the energization-cutoff cooling water temperature THWCT, as an energization-cutoff warm-up state to cut off the energization, based on the at-startup intake temperature STHA and the at-startup cooling water temperature STHW (i.e., the aforesaid warm-up states at startup of the engine 1), and energize each heating film 29 and 30 and then cut off the energization based on the energization-cutoff cooling water temperature THWCT. To be specific, when the intake temperature THA is equal to or higher than the predetermined value (−20° C.) after IG-ON, the ECU 80 is configured to cut off the energization when the cooling water temperature THW becomes equal to or higher than the energization-cutoff cooling water temperature THWCT. Further, when the intake temperature THA is equal to or lower than the predetermined value (−20° C.), the ECU 80 is configured to keep each heating film 29 and 30 in an always-ON, or energized, state.

(Operations and Effects of the EGR System)

According to the EGR system configured as above in the present embodiment, the following operations and effects, different from those in the first embodiment, can be achieved. Specifically, the ECU 80 energizes each heating film 29 and 30 and then cuts off the energization based on the energization-cutoff cooling water temperature THWCT (the energization-cutoff warm-up state) calculated according to the at-startup intake temperature STHA and the at-startup cooling water temperature STHW. Accordingly, the heating time (that is, the heat generation time) of each heating film 29 and 30 is adjusted according to the at-startup intake temperature STHA and the at-startup cooling water temperature STHW. This configuration does not energize each heating film 29 and 30 more than necessary and therefore needless energization can be prevented.

Third Embodiment

A third embodiment will be described below in detail referring to the accompanying drawings.

(Third Energization Control of Heating Films)

Figure 16:
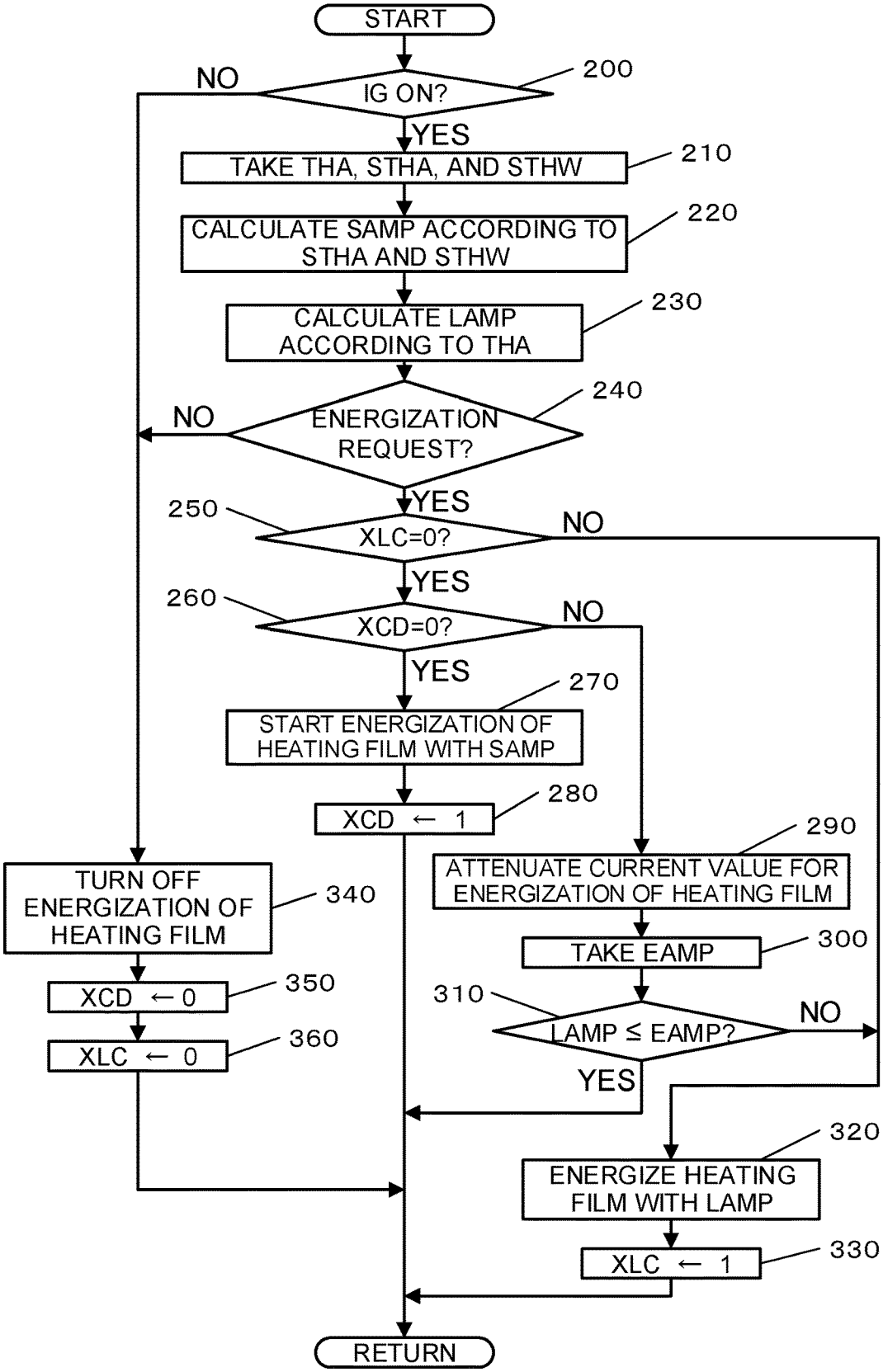
FIG. 16 is a flowchart showing the contents of third energization control in a third embodiment.

This third embodiment differs from each of the foregoing embodiments in the contents of the third energization control of each heating film 29 and 30. FIG. 16 is a flowchart showing the contents of the third energization control in the present embodiment.

When the processing shifts to this routine, in step 200, the ECU 80 determines whether or not IG is ON, that is, the engine 1 has started the startup operation, based on a detection signal from the IG switch 78. When this determination result is YES, the ECU 80 advances the processing to step 210. When this determination result is NO, the ECU 80 shifts the processing to step 340.

In step 210, the ECU 80 individually takes the intake temperature THA, the at-startup intake temperature STHA, and the at-startup cooling water temperature STHW based on detected values of the water temperature sensor 71 and the intake temperature sensor 77.

In step 220, the ECU 80 calculates a current value SAMP (unit: A) required for starting energization of each heating film 29 and 30 (an energization-start current value) after startup according to the at-startup intake temperature STHA and the at-startup cooling water temperature STHW. The ECU 80 can obtain this energization-start current value SAMP according to the at-startup intake temperature STHA and the at-startup cooling water temperature STHW by referring to for example an energization-start current value map as shown in FIG. 17. In this map, the energization-start current value SAMP is set higher as each of the at-startup intake temperature STHA and the at-startup cooling water temperature STHW is lower.

In step 230, the ECU 80 calculates a lower-limit current value LAMP (unit: A) according to the intake temperature THA. The ECU 80 can this lower-limit current value LAMP according to the intake temperature THA by referring to for example a lower-limit current value map as shown in FIG. 18. In this map, the lower-limit current value LAMP is set lower in a range of 1.5 to 0.2 (A) as the intake temperature THA is higher in a range of −20 to 50 (° C.).

In step 240, the ECU 80 then determines whether or not there is a request for energization (namely, an energization request) of each heating film 29 and 30. The ECU 80 can determine the energization request for example when the intake temperature THA is a predetermined low temperature and also the cooling water temperature THW is not a predetermined high temperature. When the energization request is present, the ECU 80 advances the processing to step 250. When the energization request is not present (Energization cutoff), the ECU 80 shifts the processing to step 340.

In step 250, the ECU 80 determines whether or not a lower-limit current value energization flag XLC, which will be mentioned later, is 0. When this determination result is YES, the ECU 80 advances the processing to step 260. When this determination result is NO, the ECU 80 shifts the processing to step 320.

In step 260, the ECU 80 determines whether or not a current value attenuation flag XCD, which will be mentioned later, is 0. When this determination result is YES, the ECU 80 advances the processing to step 270. When this determination result is NO, the ECU 80 shifts the processing to step 290.

In step 270, the ECU 80 starts energization of each heating film 29 and 30 with the energization-start current value SAMP.

After starting energization of each heating film 29 and 30, the ECU 80 sets the current value attenuation flag XCD to 1 in step 280 and then returns the processing to step 200.

In step 320 following step 250, the ECU 80 energizes each heating film 29 and 30 with the lower-limit current value LAMP.

After energizing each heating film 29 and 30 with the lower-limit current value LAMP, the ECU 80 sets the lower-limit current value energization flag XLC to 1 in step 330 and then returns the processing to step 200.

In step 290 following step 260, the ECU 80 attenuates a current value for energizing each heating film 29 and 30. For example, the ECU 80 can attenuate this energization current value at a rate of 0.001 (A) per 1 second.

In step 300, the ECU 80 subsequently takes an energization current value EAMP under attenuation.

In step 310, the ECU 80 further determines whether or not the energization current value EAMP under attenuation is equal to or larger than the lower-limit current value LAMP. When this determination result is YES, the ECU 80 returns the processing to step 200. When this determination result is NO, the ECU 80 shifts the processing to step 320.

On the other hand, in step 340 following step 200 or step 240, the ECU 80 turns off energization of each heating film 29 and 30, that is, cuts off the energization.

In step 350, the ECU 80 sets the current value attenuation flag XCD to 0.

In step 360, the ECU 80 sets the lower-limit current value energization flag XLC to 0 and returns the processing to step 200.

According to the foregoing third energization control, the ECU 80 is configured to control energization of each heating film 29 and 30 from before start of EGR based on the warm-up states of the intake passage 2 and the EGR passage 12 (including the EGR gas distributor 15). Herein, for energization of each heating film 29 and 30, the ECU 80 is configured to control a current value for energizing each heating film 29 and 30 based on the foregoing warm-up states at startup of the engine 1. To be concrete, when there is a request for energizing each heating film 29 and 30 after IG-ON, the ECU 80 is configured to start energization of each heating film 29 and 30 with the energization-start current value SAMP according to the at-startup intake temperature STHA and the at-startup cooling water temperature STHW. Herein, the ECU 80 is configured to increase the energization-start current value SAMP as the at-startup intake temperature STHA and the at-startup cooling water temperature STHW are lower. Further, the ECU 80 is configured to attenuate the energization current value EAMP to a predetermined lower-limit current value LAMP after starting energization of each heating film 29 and 30. Herein, the ECU 80 is arranged to set the lower-limit current value LAMP according to the intake temperature THA.

(Behaviors of Various Parameters During Execution of the Third Energization Control)

Herein, the behaviors of various parameters during execution of the foregoing third energization control will be described below by reference to a time chart shown in FIG. 19. The behaviors of various parameters in FIG. 19 (*a*) to (*e*) are the same as those in FIG. 13 (*a*) to (*e*), and FIG. 19 (*f*) shows changes in energization current value EAMP. In the present embodiment, similarly, the cooling water temperature THW for starting EGR is set to 40° C.

Figure 19:
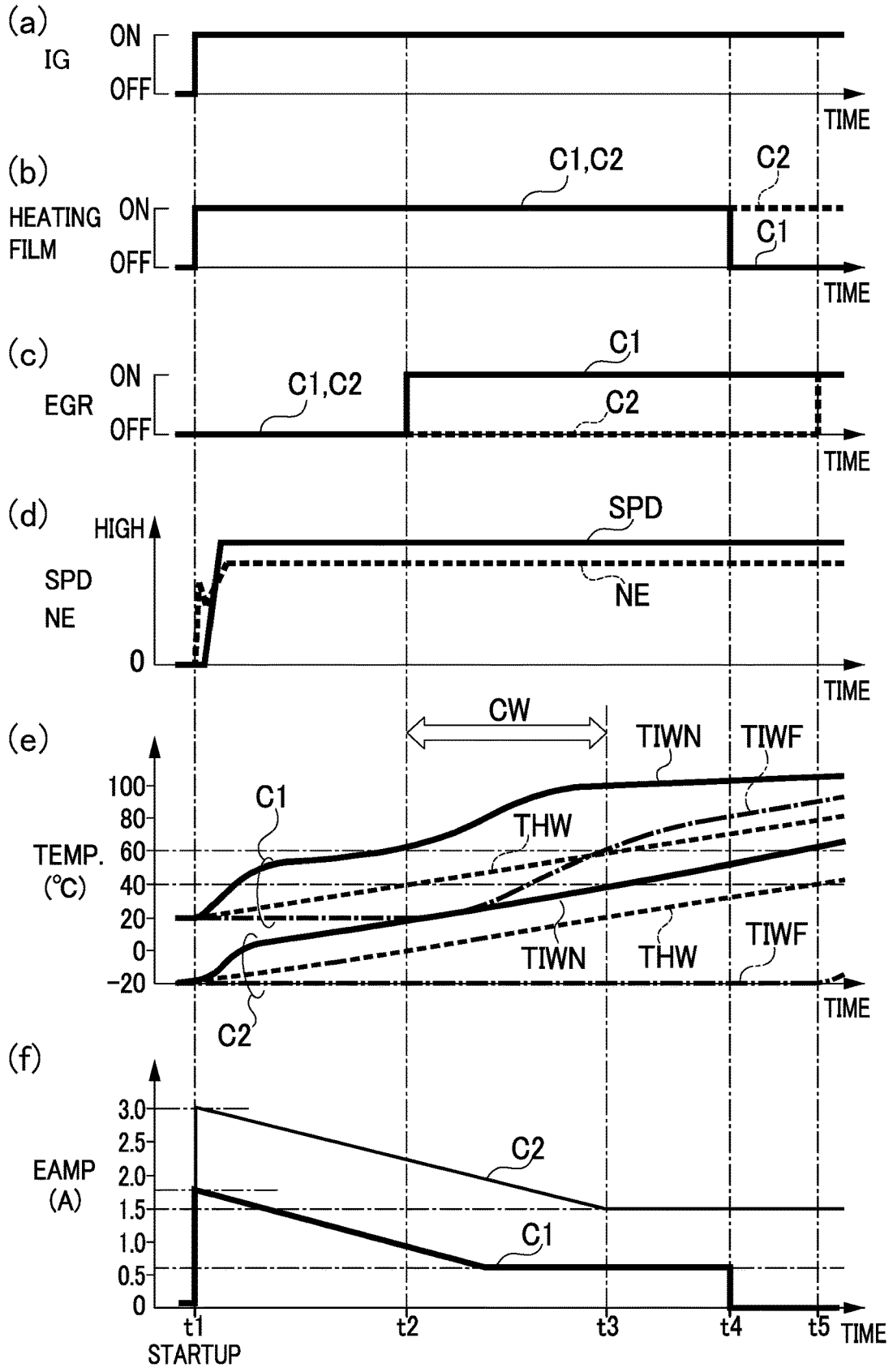
FIG. 19 is a time chart showing behaviors of various parameters during execution of the third energization control in the third embodiment.

In FIG. 19 (*f*), the first case C1 indicated by a solid line shows changes in energization current value EAMP applied when the at-startup intake temperature STHA and the at-startup cooling water temperature STHW are 20° C. In the first case C1, at time t1, energization of each heating film 29 and 30 is started with an energization-start current value SAMP of 1.75 (A). Subsequently, the current value is attenuated to 0.6 (A) which is the lower-limit current value LAMP, and this lower-limit current value LAMP is held and then, at time t4, energization is cut off.

In the first case C1, if energization of each heating film 29 and 30 is not turned on, (e) the inner wall temperature TIWF starts to increase after time t2 by being heated by the heat of introduced EGR gas and reaches the dew-point temperature (60° C.) at time t3. Accordingly, if energization of each heating film 29 and 30 is not turned on, condensed water generation CW occurs in the EGR gas distributor 15 in a period from time t2 to time t3. To prevent this condensed water generation CW, the ECU 80 has to wait the start of EGR until time t3. In the present embodiment, in the first case C1, energization of each heating film 29 and 30 is turned on at the same time as startup of the engine 1, i.e., from before start of EGR. Therefore, at relatively early time t2, even when the cooling water temperature THW reaches 40° C. and EGR is started, the inner wall temperature TIWN exceeds the dew-point temperature (60° C.) at that time and thus EGR can be started without generating condensed water in the EGR gas distributor 15.

In FIG. 19 (*f*), the second case C2 indicated by a thin solid line shows changes in energization current value EAMP applied when the at-startup intake temperature STHA and the at-startup cooling water temperature STHW are −20° C. In the second case C2, at time t2, energization of each heating film 29 and 30 is started with an energization-start current value SAMP of 3.0 (A). Thereafter, the current value is attenuated to 1.5 (A) which is the lower-limit current value LAMP, and this lower-limit current value LAMP is held.

In the second case C2, if energization of each heating film 29 and 30 is not turned on, the cooling water temperature THW reaches 40° C., at time t5, which is the cooling water temperature THW for starting EGR and EGR is started. On the other hand, (e) the inner wall temperature TIWF remains −20° C. until time t5 and starts to increase after time t5 by being heated by the heat of introduced EGR gas. Thus, if energization of each heating film 29 and 30 is not turned on, condensed water generation CW occurs in the EGR gas distributor 15 at the same time as start of EGR. To prevent this condensed water generation CW, the ECU 80 has to wait the start of EGR until the inner wall temperature TIWF reaches the dew-point temperature (60° C.). In the present embodiment, as shown in FIG. 19 (*f*), energization of each heating film 29 and 30 is turned on concurrently with startup of the engine 1, that is, from before start of EGR, and the energization of each heating film 29 and 30 is started with a high energization-start current value SAMP (3.0 (A)) according to the at-startup intake temperature STHA and the at-startup cooling water temperature STHW of −20° C. Thus, at time t5 at which EGR is started, the inner wall temperature TIWN exceeds the dew-point temperature (60° C.) and hence the EGR can be started without causing the generation of condensed water in the EGR gas distributor 15.

(Operations and Effects of the EGR System)

According to the EGR system configured as above in the present embodiment, the following operations and effects, different from those in the first embodiment, can be achieved. Specifically, for energization of each heating film 29 and 30, the ECU 80 controls the energization current value EAMP (a current value for energization) based on the at-startup intake temperature STHA and the at-startup cooling water temperature STHW (the warm-up states at startup of the engine 1). Accordingly, the heating state (the heating temperature) of each heating film 29 and 30 is adjusted according to the at-startup intake temperature STHA and the at-startup cooling water temperature STHW. Therefore, even under a low temperature, it is possible to rapidly increase the temperature of the inner walls of the EGR gas distributor 15 (the EGR passage).

According to the present embodiment configured as above, for energization of each heating film 29 and 30, the energization is started with the energization-start current value SAMP and then this current value is attenuated to the lower-limit current value LAMP. Therefore, as compared with the case where energization is continued with the same energization-start current value SAMP until the energization is turned off, the present embodiment can reduce power consumption and save energy for energization control.

According to the embodiment configured as above, furthermore, the ECU 80 sets the lower-limit current value LAMP related to energization of each heating film 29 and 30 according to the intake temperature THA. Therefore, the cold state of the EGR gas distributor 15 due to travelling wind or air which is assumed during running of a vehicle can be compensated by energization of each heating film 29 and 30 with the lower-limit current value LAMP.

Fourth Embodiment

A fourth embodiment will be described below in detail with reference to the accompanying drawings.

Figure 20:
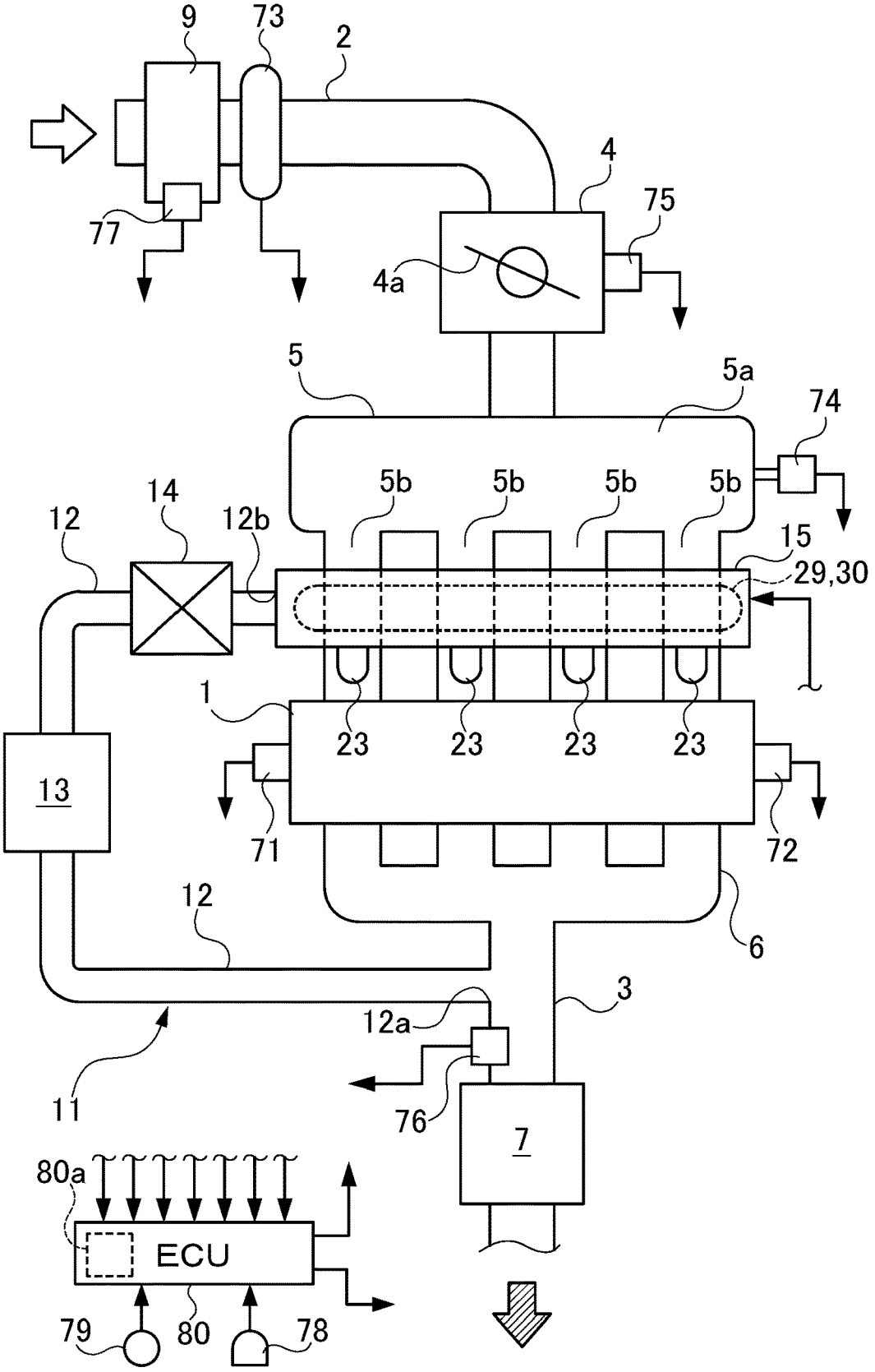
FIG. 20 is a schematic configuration view of an engine system in a fourth embodiment.

This fourth embodiment differs from each of the foregoing embodiments in the electrical configuration of the engine system and the contents of the fourth energization control of each heating film 29 and 30. FIG. 20 is a schematic configuration view of an engine system in the present embodiment. The electrical configuration in this embodiment differs from that shown in FIG. 1 in that the ECU 80 includes a pre ECU 80*a* configured to operate before startup of the engine 1 and a door sensor 79 is connected to the ECU 80, as shown in FIG. 20. The door sensor 79 is provided in a driver's seat door (not shown) of a vehicle mounted with this engine system and is configured to detect opening/closing of the driver's seat door and output an electric signal representing a detection result.

(Fourth Energization Control of Heating Films)

Figure 21:
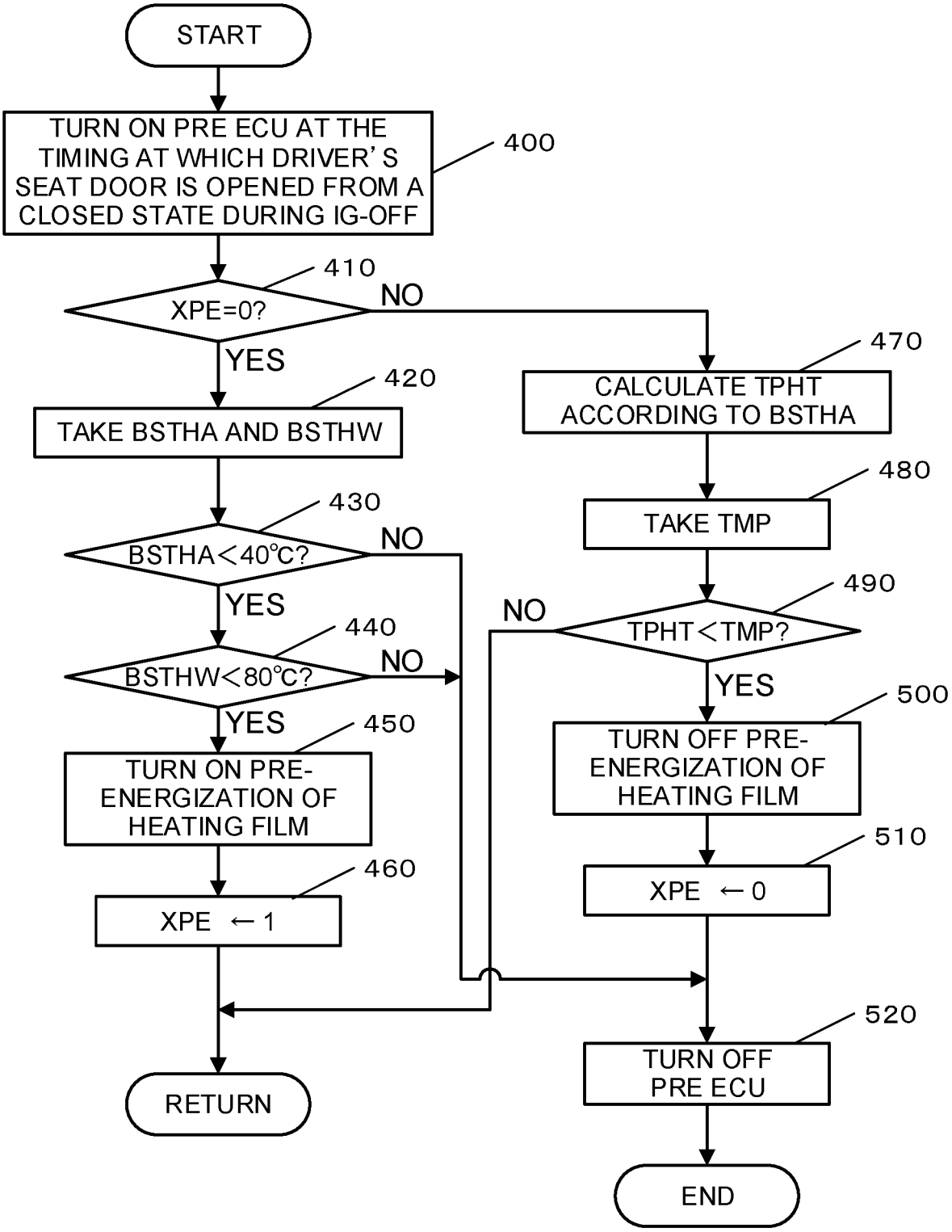
FIG. 21 is a flowchart showing the contents of fourth energization control in the fourth embodiment.

FIG. 21 is a flowchart showing the contents of the fourth energization control in the present embodiment. The ECU 80 is configured to execute the fourth energization control before execution of the first to third energization controls in the respective embodiments described above.

When the processing shifts to this routine, in step 400, the ECU 80 turns on the pre ECU 80*a* at the timing at which the driver's seat door is opened from a closed state during IG-OFF. The ECU 80 can determine that the driver's seat door is opened from the closed state based on a detection result of the door sensor 79.

In step 410, the pre ECU 80*a* (i.e., the ECU 80) determines whether or not a pre-energization flag XPE which will be mentioned later is 0. When this determination result is YES, the pre ECU 80*a* advances the processing to step 420. When this determination result is NO, the pre ECU 80*a* shifts the processing to step 470.

In step 420, the pre ECU 80*a* (the ECU 80) takes an intake temperature before startup of the engine 1, namely, a pre-startup intake temperature BSTHA, and a cooling water temperature before startup of the engine 1, namely, a pre-startup cooling water temperature BSTHW, respectively based on detected values of the intake temperature sensor 77 and the water temperature sensor 71.

In step 430, the pre ECU 80*a* (the ECU 80) determines whether or not the pre-startup intake temperature BSTHA is lower than 40° C. When this determination result is YES, the pre ECU 80*a* advances the processing to step 440. When this determination result is NO, the pre ECU 80*a* shifts the processing to step 520.

In step 440, the pre ECU 80*a* (the ECU 80) determines whether or not the pre-startup cooling water temperature BSTHW is lower than 80° C. When this determination result is YES, the pre ECU 80*a* advances the processing to step 450. When this determination result is NO, the pre ECU 80*a* shifts the processing to step 520.

In step 450, the pre ECU 80*a* (the ECU 80) turns on pre-energization of each heating film 29 and 30.

After turning on the pre-energization, the pre ECU 80*a* (the ECU 80) sets the pre-energization flag XPE to 1 in step 460 and returns the processing to step 400.

On the other hand, in step 470 following step 410, the pre ECU 80*a* (the ECU 80) calculates a pre-energization time TPHT according to the pre-startup intake temperature BSTHA. The pre ECU 80*a* can obtain this pre-energization time TPHT (unit: seconds) according to the pre-startup intake temperature BSTHA by referring to for example a pre-energization time map as shown in FIG. 22. In this map, the pre-energization time TPHT is set shorter in a range of 30 to 10 (seconds) as the pre-startup intake temperature BSTHA is higher in a range of −20 to 50 (° C.).

In step 480, the pre ECU 80*a* (the ECU 80) takes an elapsed time TMP after the pre-energization. The pre ECU 80*a* is configured to measure this elapsed time TMP after start of the pre-energization.

In step 490, the pre ECU 80*a* (the ECU 80) determines whether or not the elapsed time TMP exceeds the pre-energization time TPHT. When this determination result is YES, the pre ECU 80*a* advances the processing to step 500. When this determination result is NO, the pre ECU 80*a* returns the processing to step 400.

In step 500, the pre ECU 80*a* (the ECU 80) turns off the pre-energization of each heating film 29 and 30.

After turning off the pre-energization, the pre ECU 80*a* (the ECU 80) sets the pre-energization flag XPE to 0 in step 510.

In step 520 following step 430, step 440, or step 510, the ECU 80 turns off the pre ECU 80*a* and terminates subsequent processing once.

According to the foregoing fourth energization control, the ECU 80 is configured to control energization of each heating film 29 and 30 from before start of EGR based on the warm-up states of the intake passage 2 and the EGR passage 12 (including the EGR gas distributor 15). Herein, the ECU 80 is configured to start energization of each heating film 29 and 30 prior to startup of the engine 1 based on the pre-startup intake temperature BSTHA and the pre-startup cooling water temperature BSTHW (i.e., the foregoing warm-up states before startup of the engine 1). The determination by the pre ECU 80*a* (the ECU 80) whether or not the elapsed time TMP exceeds the pre-energization time TPHT in step 490 as described above is intended to check the passage of the pre-energization time TPHT after start of pre-energization because there is a case where the engine 1 is not started even after the driver's seat door is opened from a closed state. When the IG is turned on during execution of this fourth energization control, the ECU 80 goes to the foregoing first to third energization controls.

(Operations and Effects of the EGR System)

According to the EGR system configured as above in the present embodiment, the following operations and effects, different from those in the first embodiment, can be achieved. Specifically, the ECU 80 starts energization of each heating film 29 and 30 before startup of the engine 1 based on the pre-startup intake temperature BSTHA and the pre-startup cooling water temperature BSTHW. Accordingly, the heating films 29 and 30 start generating heat from before startup of the engine 1 and each heating temperature is increased moderately. This can increase the temperature of the inner walls of the EGR gas distributor 15 to a moderate temperature by the time of startup of the engine 1. Consequently, this configuration can reliably suppress the generation of condensed water in the EGR gas distributor 15 when EGR is started.

Fifth Embodiment

A fifth embodiment will be described below in detail with reference to the accompanying drawings.

(Fifth Energization Control of Heating Films)

Figure 23:
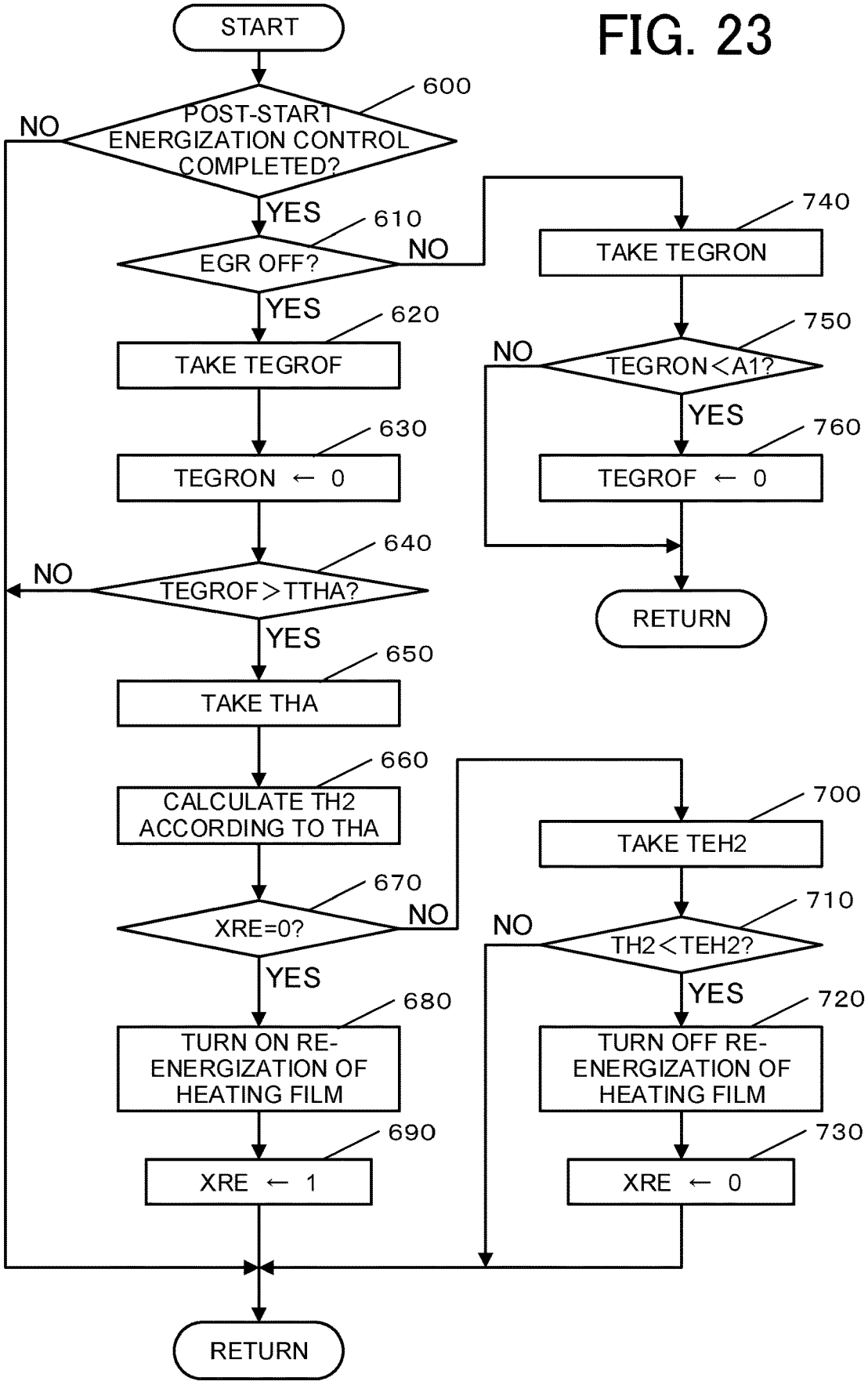
FIG. 23 is a flowchart showing the contents of fifth energization control in a fifth embodiment.

This fifth embodiment differs from each of the foregoing embodiments in the contents of the fifth energization control of each heating film 29 and 30. FIG. 23 is a flowchart showing the contents of the fifth energization control in the present embodiment.

When the processing shifts to this routine, in step 600, the ECU 80 determines whether or not the energization control after startup (namely, post-startup energization control) is completed. Herein, the post-startup energization control includes for example any one of the first to third energization controls described above to be executed after startup of the engine 1. When this determination result is YES, the ECU 80 advances the processing to step 610. When this determination result is NO, the ECU 80 returns the processing to step 600.

In step 610, the ECU 80 determines whether or not EGR is OFF, that is, EGR is not being executed. When this determination result is YES, the ECU 80 advances the processing to step 620. When this determination result is NO, the ECU 80 advances the processing to step 740.

In step 620, the ECU 80 takes a time for turning off EGR (an EGR-OFF time) TEGROF. After turning off EGR, the ECU 80 is configured to measure this EGR-OFF time TEGROF.

In step 630, the ECU 80 clears a time for turning on EGR, namely, a time for executing EGR (an EGR-ON time) TEGRON.

In step 640, the ECU 80 determines whether or not the EGR-OFF time TEGROF exceeds a predetermined determination time TTHA. When this determination result is YES, the ECU 80 judges that the EGR-OFF time TEGROF is long and shifts the processing to step 650. When this determination result is NO, the ECU 80 judges that the EGR-OFF time TEGROF is short and returns the processing to step 600.

In step 650, the ECU 80 takes an intake temperature THA based on a detected value of the intake temperature sensor 77.

In step 660, the ECU 80 calculates a re-energization time TH2 according to the intake temperature THA. The ECU 80 can obtain this re-energization time TH2 according to the intake temperature THA by referring to a predetermined re-energization time map (not shown).

In step 670, the ECU 80 determines whether or not a re-energization flag XRE which will be mentioned later is 0. When this determination result is YES, the ECU 80 advances the processing to step 680. When this determination result is NO, the ECU 80 shifts the processing to step 700.

In step 680, the ECU 80 turns on re-energization of each heating film 29 and 30.

After turning on re-energization of each heating film 29 and 30, the ECU 80 sets the re-energization flag XRE to 1 in step 690 and returns the processing to step 600.

In step 700 following step 670, the ECU 80 takes an actual re-energization time TEH2. After starting the re-energization, the ECU 80 is configured to measure this actual re-energization time TEH2.

In step 710, the ECU 80 determines whether or not the actual re-energization time TEH2 exceeds the re-energization time TH2. When this determination result is YES, the ECU 80 advances the processing to step 720. When this determination result is NO, the ECU 80 returns the processing to step 600.

In step 720, the ECU 80 turns off re-energization of each heating film 29 and 30.

In step 730, the ECU 80 sets the re-energization flag XRE to 0 and then returns the processing to step 600.

On the other hand, in step 740 following step 610, the ECU 80 takes the EGR-ON time TEGRON. After turning on EGR, the ECU 80 is configured to measure this EGR-ON time TEGRON.

In step 750, the ECU 80 determines whether or not the EGR-ON time TEGRON is longer than a predetermined time A1. When this determination result is YES, the ECU 80 advances the processing to step 760. When this determination result is NO, the ECU 80 returns the processing to step 600.

In step 760, the ECU 80 clears the EGR-ON time TEGRON to 0 and then returns the processing to step 600.

According to the fifth energization control described above, when EGR cutoff is continued only for the predetermined determination time TTHA (a predetermined time), the ECU 80 is configured to execute re-energization of each heating film 29 and 30 based on the intake temperature THA (i.e., the warm-up state) after startup of the engine 1.

(Operations and Effects of the EGR System)

According to the EGR system configured as above in the present embodiment, the following operations and effects can be achieved in addition to the operations and effects in the first to third embodiments. Specifically, when EGR cutoff is continued only for the predetermined time, the re-energization of each heating film 29 and 30 is performed based on the intake temperature THA after startup of the engine 1, so that the heating films 29 and 30 generate heat as needed even after EGR cutoff. This can keep the temperature of the inner walls of the EGR gas distributor 15 to a moderate temperature even after EGR cutoff. Consequently, even when EGR gas is introduced again after a lapse of an arbitrary time after EGR cutoff, it is possible to suppress the generation of condensed water in the EGR gas distributor 15.

Sixth Embodiment

A sixth embodiment will be described below in detail with reference to the accompanying drawings.

Figure 24:
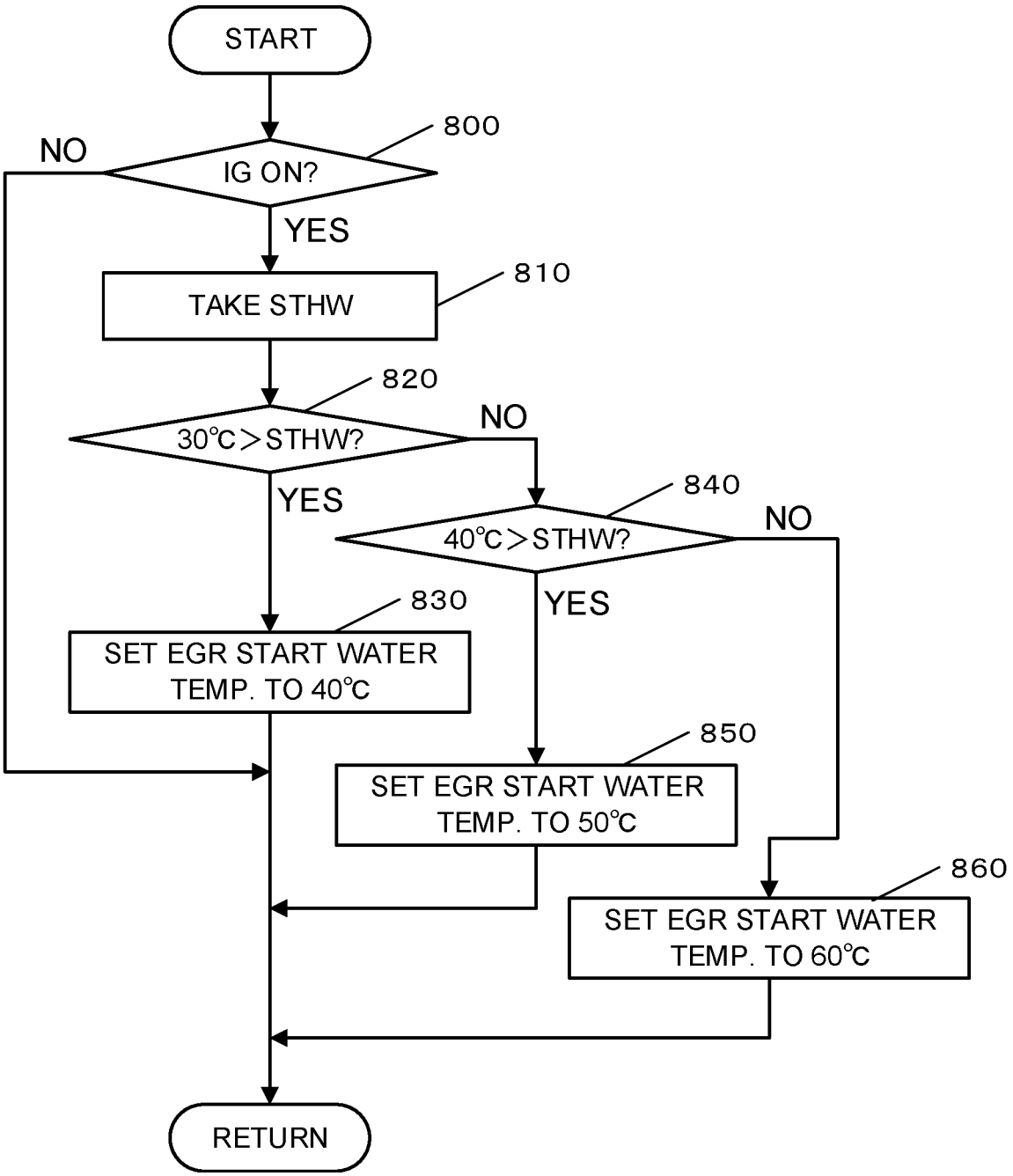
FIG. 24 is a flowchart showing the contents of an EGR start water temperature setting control in a sixth embodiment.

In recent years, there is a growing demand for EGR to be implemented at an early stage after engine startup. However, if EGR is to be performed at the early stage after engine startup, a cooling water temperature THW (namely, an EGR start water temperature) used as a target for EGR start has to be set lower, that is, set close to room temperature. If the EGR start water temperature is set lower, the energization time for heating each heating film 29 and 30 before start of EGR becomes short depending on the state of the cooling water temperature at engine startup, namely, an at-startup cooling water temperature STHW. This may cause a problem that the inner walls of the EGR gas distributor 15 could not be sufficiently warmed. In the present embodiment, therefore, the following EGR start water temperature setting control is performed. FIG. 24 is a flowchart showing the contents of this control. In this control, the EGR start water temperature used as a criterion is set to 40° C. which is lower than a normal temperature.

(EGR Start Water Temperature Setting Control)

When the processing shifts to this routine, in step 800, the ECU 80 determines whether or not IG is ON, that is, the engine 1 has started a startup operation, based on a detection signal from the IG switch 78. When this determination result is YES, the ECU 80 advances the processing to step 810. When this determination result is NO, the ECU 80 returns the processing to step 800.

In step 810, the ECU 80 takes an at-startup cooling water temperature STHW based on a detected value of the water temperature sensor 71. This at-startup cooling water temperature STHW is used to estimate the warm-up state of the EGR gas distributor 15 at startup of the engine 1.

In step 820, the ECU 80 determines whether or not the at-startup cooling water temperature STHW is lower than 30° C. Herein, this temperature, 30° C., is one example. When the at-startup cooling water temperature STHW is lower than 30° C., the ECU 80 advances the processing to step 830. When the at-startup cooling water temperature STHW is equal to or higher than 30° C., the ECU 80 shifts the processing to step 840.

In step 830, the ECU 80 sets the EGR start water temperature to 40° C. which is a criterion and then returns the processing to step 800. This EGR start water temperature represents the temperature used as a criterial temperature for EGR start in a separate EGR control. In the EGR control, the ECU 80 is configured to start EGR, that is, open the EGR valve and others when the cooling water temperature THW is 40° C. or higher.

On the other hand, in step 840 following step 820, the ECU 80 determines whether or not the at-startup cooling water temperature STHW is lower than the criterion, 40° C. When the at-startup cooling water temperature STHW is lower than 40° C., wherein 30° C.≤STHW<40° C., the ECU 80 advances the processing to step 850. When the at-startup cooling water temperature STHW is 40° C. or higher, the ECU 80 shifts the processing to step 860.

In step 850, the ECU 80 sets the EGR start water temperature to 50° C., which is higher than the criterion, 40° C., and then returns the processing to step 800. In this case, the ECU 80 is configured to start EGR, that is, open the EGR valve and others when the cooling water temperature THW is 50° C. or higher.

In step 860, on the other hand, the ECU 80 sets the EGR start water temperature to 60° C., which is further higher than the criterion, 40° C., and then returns the processing to step 800. In this case, the ECU 80 is configured to start EGR, that is, open the EGR valve and others when the cooling water temperature THW is 60° C. or higher in the EGR control.

In the present embodiment, the foregoing third energization control is performed as the energization control of each heating film 29 and 30.

According to the above-described EGR start water temperature setting control, when a difference is small between the at-startup cooling water temperature STHW representing the warm-up state at startup of the engine 1 and the EGR start water temperature representing the warm-up state to start EGR, the ECU 80 is configured to change the EGR start water temperature to a higher temperature.

(Behaviors of Various Parameters During Execution of Each Energization Control after the EGR Start Water Temperature is Set)

Herein, the behaviors of various parameters during execution of each energization control after the EGR start water temperature is set will be described below with reference to a time chart shown in FIG. 25. The parameters in FIG. 25 (*a*) to (*f*) are the same as those in FIG. 19 (*a*) to (*f*).

Figure 25:
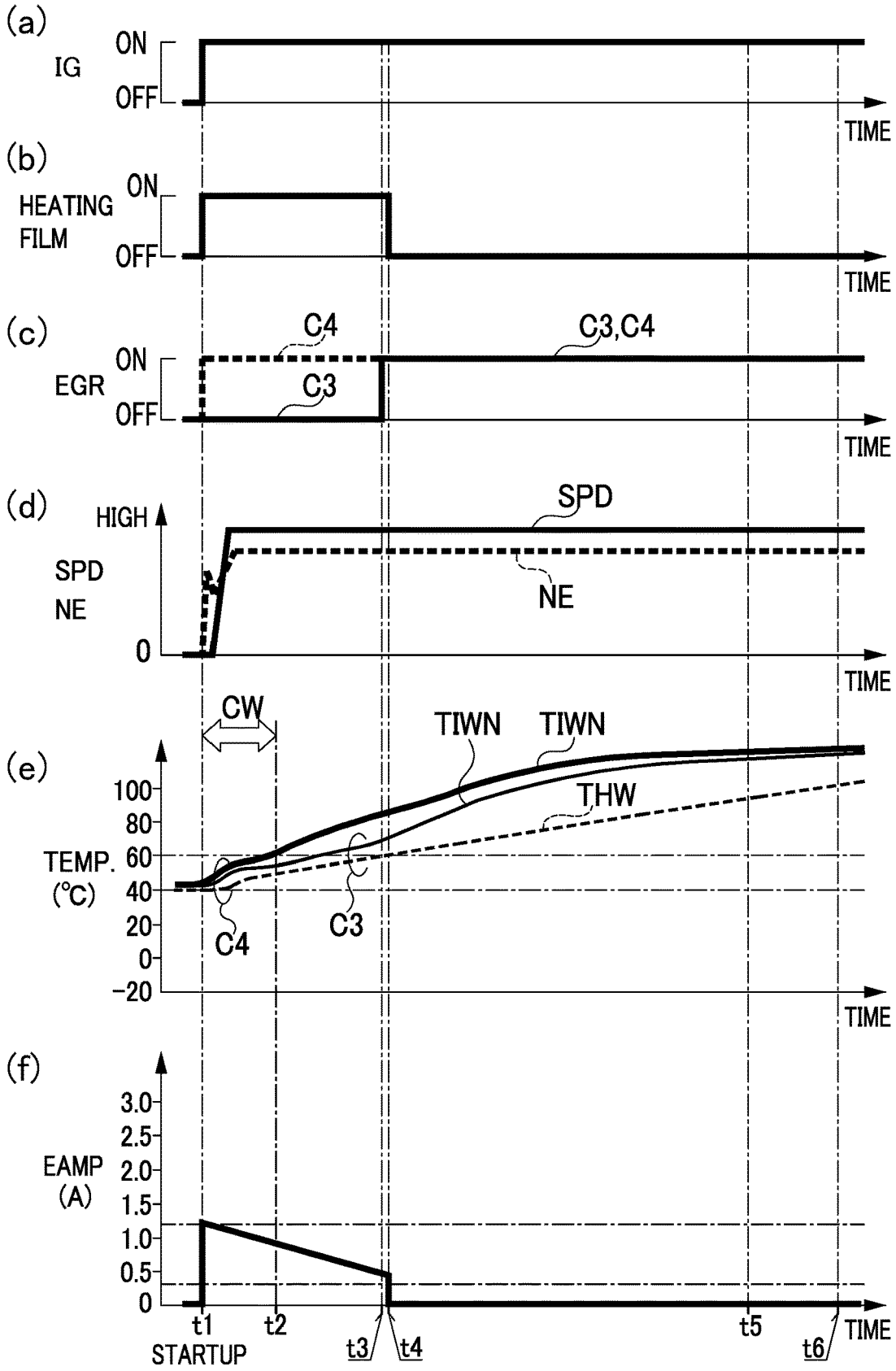
FIG. 25 is a time chart showing behaviors of various parameters during execution of each energization control after setting the EGR start water temperature in the sixth embodiment.

In FIG. 25 (*c*), the third case C3 indicated by a thick solid line shows switching between ON and OFF of EGR when the inner wall temperature TIWN and the at-startup cooling water temperature STHW are set to 42° C. and the EGR start water temperature is set to 60° C. This third case C3 assumes an example that a difference between the cooling water temperature THW (42° C.) at engine startup and the EGR start water temperature (40° C.) which is a criterion is small and the EGR start water temperature is changed to 60° C. The fourth case C4 indicated by a thick broken line shows switching between ON and OFF of EGR when the inner wall temperature TIWN and the at-startup cooling water temperature STHW are 42° C. and the EGR start water temperature is set to the criterion, 40° C. This fourth case C4 assumes assumes an example that even when a difference between the cooling water temperature THW (42° C.) at engine startup and the EGR start water temperature (40° C.) which is a criterion is small, the EGR start water temperature is not changed and held at 40° C.

In FIG. 25 (*e*), a thin solid line shows changes in inner wall temperature TIWN of the EGR gas distributor 15 in the above-described case C3 when energization of each heating film 29 and 30 is turned on. A thick solid line shows changes in inner wall temperature TIWN of the EGR gas distributor 15 in the above-described case C4 when energization of each heating film 29 and 30 is turned on. A broken line indicates changes in cooling water temperature THW.

In FIG. 25, when (a) IG is turned on (engine startup) at time t1, (b) energization of each heating film 29 and 30 is turned on (start of heating), and (d) the engine rotation speed NE starts to increase and the vehicle speed SPD starts a little late to increase. At that time, (f) the energization current value EAMP is set to an energization-start current value SAMP of 1.2 (A) and then attenuates. When the energization request is cleared at time t4, (f) the energization current value EAMP becomes 0 and (b) energization of each heating film 29 and 30 is turned off (stop of heating).

Herein, in the third case C3, at time t3, when (e) the cooling water temperature THW reaches 60° C. changed from 40° C., (c) EGR is turned on. In other words, in the third case C3, each heating film 29 and 30 generates heat in a period from time t1 to time t3, earlier than start of EGR. At time t3 at which EGR is started, (e) the inner wall temperature TIWN exceeds the dew-point temperature (60° C.) and accordingly, even when EGR is started, no condensed water occurs in the EGR gas distributor 15.

In the fourth case C4, in contrast, at time t1, (e) the cooling water temperature THW has already exceeded 40° C. which is the EGR start water temperature and accordingly (c) EGR is turned on. In other words, in the fourth case C4, at time t1, EGR is started at 42° C. which is lower than the dew-point temperature (60° C.) and each heating film 29 and 30 generates heat. This may cause the generation of condensed water CW in the EGR gas distributor 15 in a period from time t1 to time t2 before (e) the inner wall temperature TIWN exceeds the dew-point temperature (60° C.).

(Operations and Effects of the EGR System)

According to the EGR system configured as above in the present embodiment, the following operations and effects can be achieved in addition to the operations and effects in the foregoing third embodiment. Specifically, when a difference is small between the at-startup cooling water temperature STHW representing the warm-up state at startup of the engine 1 and 40° C. set as the EGR start water temperature representing the warm-up state to start EGR, the EGR start water temperature is changed to a higher temperature, 50° C. or 60° C. This needs a long time to energize each heating film 29 and 30 from startup of the engine 1 until EGR is started. Consequently, even when the EGR start water temperature is set to a low temperature, e.g., 40° C., the EGR start water temperature is re-adjusted according to the at-startup cooling water temperature STHW, so that the temperature of the inner walls of the EGR gas distributor 15 can be increased appropriately before start of EGR.

Seventh Embodiment

A seventh embodiment will be described below in detail with reference to the accompanying drawings.

(Sixth Energization Control of Heating Films)

Figure 26:
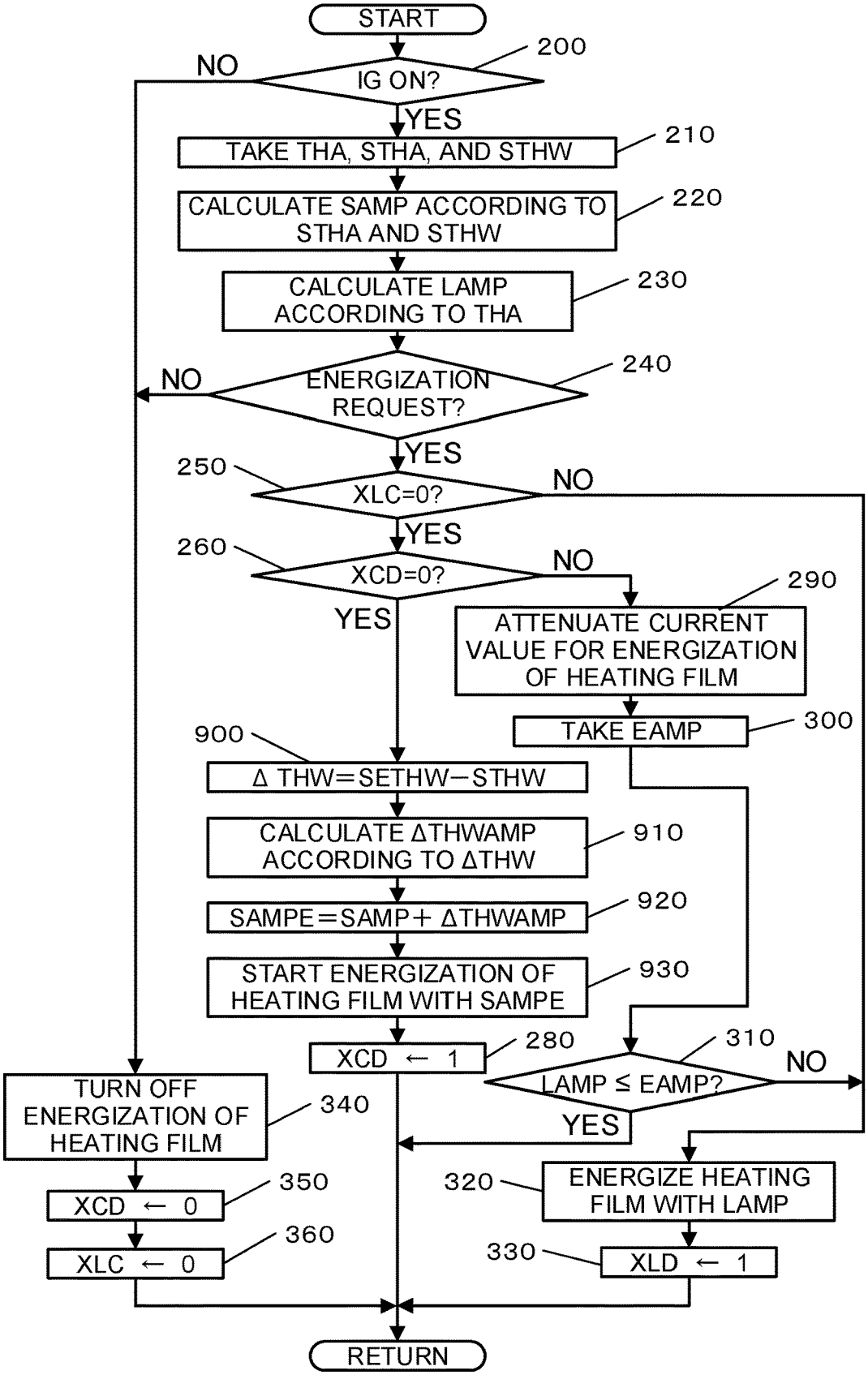
FIG. 26 is a flowchart showing the contents of sixth energization control in a seventh embodiment.

The present embodiment differs from each of the foregoing embodiments in the contents of the sixth energization control of each heating film 29 and 30. FIG. 26 is a flowchart showing the contents of the sixth energization control in the present embodiment. The flowchart in FIG. 26 includes step 900 to step 930 instead of step 270 in the flowchart in FIG. 16.

When the processing shifts to this routine, the ECU 80 performs the processing in step 200 and subsequent steps. When the determination result is YES in step 260, the ECU 80 calculates, in step 900, a water temperature difference ΔTHW between the EGR start water temperature SETHW and the at-startup cooling water temperature STHW. Herein, the EGR start water temperature SETHW can be set to for example 40° C.

In step 910, the ECU 80 then calculates an additional current value ΔTHWAMP according to the water temperature difference ΔTHW. The ECU 80 can obtain this additional current value ΔTHWAMP according to the water temperature difference ΔTHW by referring to for example an additional current value map as shown in FIG. 27. In this map, the additional current value ΔTHWAMP is set to be smaller in a range of 2 to 0 (A) as the water temperature difference ΔTHW is higher in a range of 0 to 50 (° C.).

In step 920, the ECU 80 adds the additional current value ΔTHWAMP to the energization-start current value SAMP to calculate a final energization-start current value SAMPE.

In step 930, the ECU 80 starts energizing each heating film 29 and 30 with the final energization-start current value SAMPE and then shifts the processing to step 280.

According to the above-described sixth energization control, differently from the third energization control, for energization of each heating film 29 and 30, the ECU 80 is configured to increase a current value for energization of each heating film 29 and 30 according to a difference between the warm-up states of the intake passage 2 and the EGR passage 12 (including the EGR gas distributor 15) at startup of the engine 1 and the warm-up state to start EGR. To be specific, the ECU 80 is configured to add the additional current value ΔTHWAMP according to the water temperature difference ΔTHW between the at-startup cooling water temperature STHW and the EGR start water temperature SETHW to the energization-start current value SAMP according to the at-startup intake temperature STHA and the at-startup cooling water temperature STHW to obtain the final energization-start current value SAMPE, and starts energizing each heating film 29 and 30 with the final energization-start current value SAMPE.

(Behaviors of Various Parameters During Execution of the Sixth Energization Control)

Figure 28:
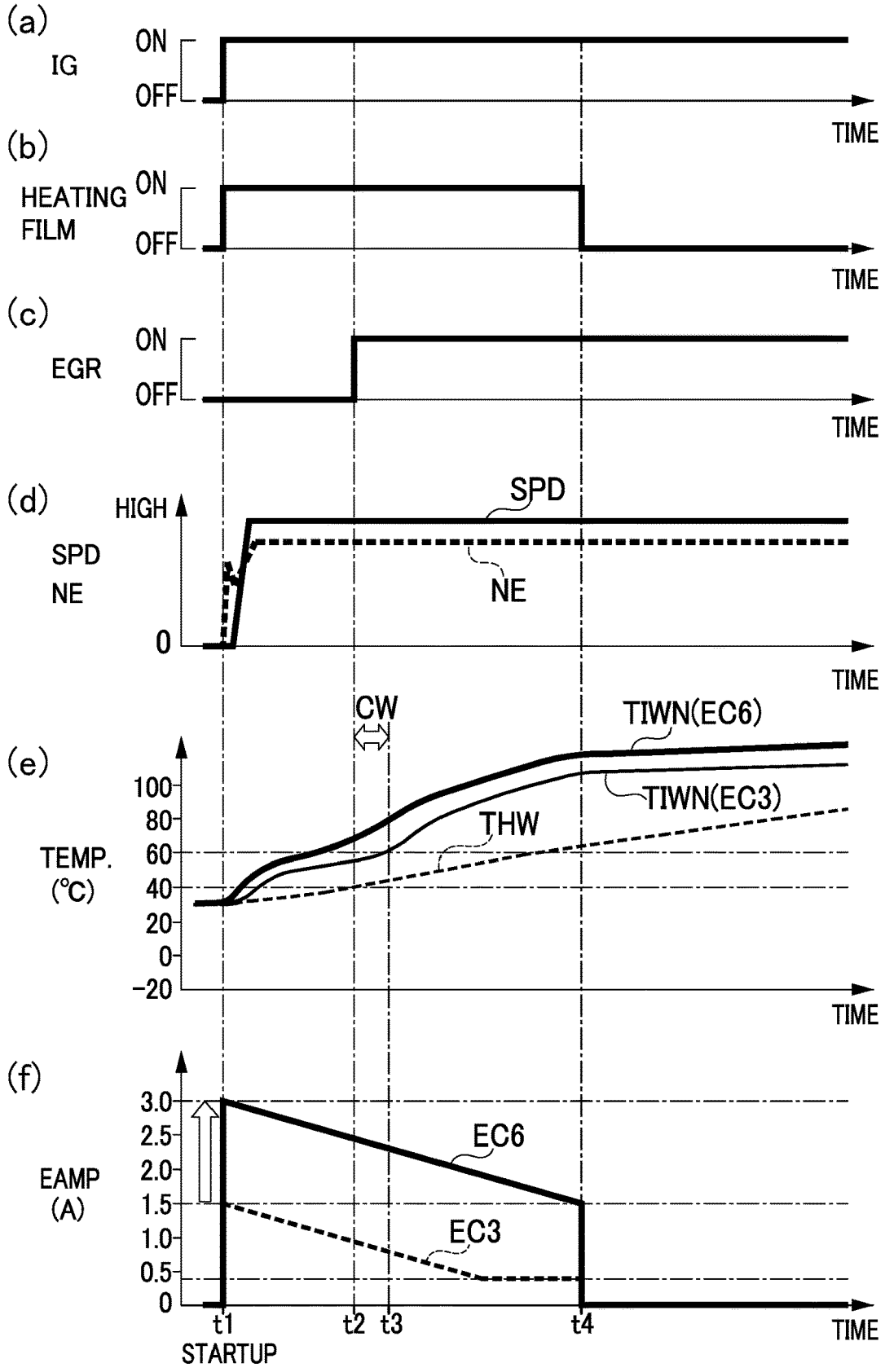
FIG. 28 is a time chart showing behaviors of various parameters during execution of the sixth energization control in the seventh embodiment.

Herein, the behaviors of various parameters during execution of the sixth energization control will be described below with reference to a time chart shown in FIG. 28. The parameters (a) to (f) in FIG. 28 are the same as the parameters (a) to (f) in FIG. 19. In FIG. 28 (*f*), a thick solid line shows the energization current value EAMP in the case EC6 of the sixth energization control in the present embodiment and a thick broken line shows the energization current value EAMP in the case EC3 of the third energization control in the third embodiment. In FIG. 28 (*e*), a thick solid line shows changes in inner wall temperature TIWN in the case EC6 in the sixth energization control in which energization of each heating film 29 and 30 is turned on, a thin solid line shows changes in inner wall temperature TIWN in the case EC3 in the third energization control in which energization of each heating film 29 and 30 is turned on, and a broken line shows changes in cooling water temperature THW.

As shown in FIG. 28, at time t1, (e) when the cooling water temperature THW is 30° C., (a) IG is turned on (startup of the engine), (b) energization of each heating film 29 and 30 is turned on (start of energization), and (d) the engine rotation speed NE and the vehicle speed SPD start to increase.

At that time, in the above-described case EC3 of the third energization control, (f) energization is started with the energization current value EAMP of 1.5 (A) corresponding to the cooling water temperature THW of 30° C. and then the energization current value EAMP is attenuated. Further, the energization current value EAMP goes down to a lower-limit current value LAMP of 0.4 (A) and, at time t4, energization is cut off and (b) energization of each heating film 29 and 30 is turned off. In this case, the EGR start water temperature SETHW is 40° C. and the at-startup cooling water temperature STHW is 30° C. Thus, a difference therebetween is as small as 10° C., so that the cooling water temperature THW reaches the EGR start water temperature SETHW at time t2 early after engine startup. The EGR is thus turned on (start of EGR). However, (e) the inner wall temperature TIWN at time t2 is lower than the dew-point temperature (60° C.). This may cause condensed water generation CW in the EGR gas distributor 15 in a period up to time t3 at which the inner wall temperature TIWN reaches the dew-point temperature (60° C.).

In contrast, in the case EC6 of the above-described sixth energization control, at time t1, (f) the energization current value EAMP (i.e., the final energization-start current value SAMPE) is 3.0 (A) calculated by addition of 1.5 (A) corresponding to a water temperature difference ΔTHW of 10° C. to the energization-start current value SAMP of 1.5 (A). With this final energization-start current value SAMPE obtained by the addition, energization of each heating film 20 and 30 is started. Thereafter, (f) the energization current value EAMP is attenuated and, at time t4, energization is cut off and (b) energization of each heating film 29 and 30 is turned off. In this case, even if the water temperature difference ΔTHW between the EGR start water temperature SETHW and the at-startup cooling water temperature STHW is as small as 10° C., the increased energization current value EAMP causes (e) the increasing rate of the inner wall temperature TIWN to increase and, at time 2 early after engine startup, (e) the inner wall temperature TIWN exceeds the dew-point temperature (60° C.). Therefore, at or after time t2, the EGR can be started without causing the generation of condensed water in the EGR gas distributor 15.

(Operations and Effects of the EGR System)

The EGR system configured as above in the present embodiment can achieve the following operations and effects in addition to the operations and effects in the foregoing third embodiment. Specifically, for energization of each heating film 29 and 30, the final energization-start current value SAMPE (i.e., a current value for energization) increases according to the water temperature difference ΔTHW between the at-startup cooling water temperature STHW (the warm-up state at startup of the engine 1) and the EGR start water temperature SETHW (the warm-up state to start EGR). Accordingly, each heating film 29 and 30 generates more heat by the amount corresponding to an increment of the current value applied from startup of the engine 1 to start of the EGR. Thus, even when the EGR start water temperature is set to a relatively low temperature (e.g., 40° C.), it is possible to rapidly increase the temperature of the inner walls of the EGR gas distributor 15 before start of EGR.

Eighth Embodiment

An eighth embodiment will be described below in detail with reference to the accompanying drawings.

Figure 29:
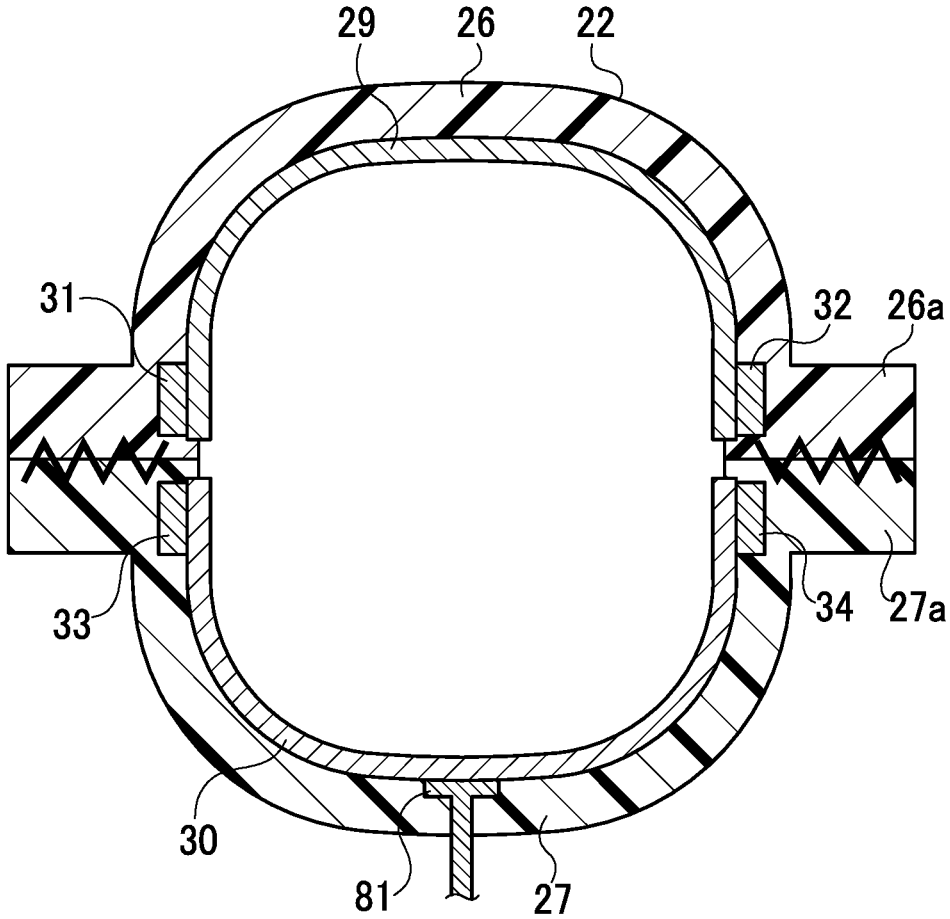
FIG. 29 is a cross-sectional view of a gas chamber of an EGR gas distributor in an eighth embodiment, equivalent to FIG. 6.

The present embodiment differs from each of the foregoing embodiments in the electrical configuration of the EGR gas distributor 15 and the contents of the seventh energization control of each heating film 29 and the 30. FIG. 29 is a cross-sectional view of the gas chamber 22 of the EGR gas distributor 15 in the present embodiment, equivalent to FIG. 6. In the present embodiment, as shown in FIG. 29, the lower casing 27 is provided with a temperature sensor 81 to detect the temperature of the inner wall of the lower casing 27. This temperature sensor 81 is connected to the ECU 80. The temperature sensor 81 is configured to detect the temperature of the inner wall of the lower casing 27 as the inner wall temperature TIW and output a detection signal to the ECU 80. In the present embodiment, the inner wall temperature TIW of only the lower casing 27 is detected; however, temperature sensors may be provided to individually detect the inner wall temperatures of the casings 26 and 27.

(Seventh Energization Control of Heating Films)

Figure 30:
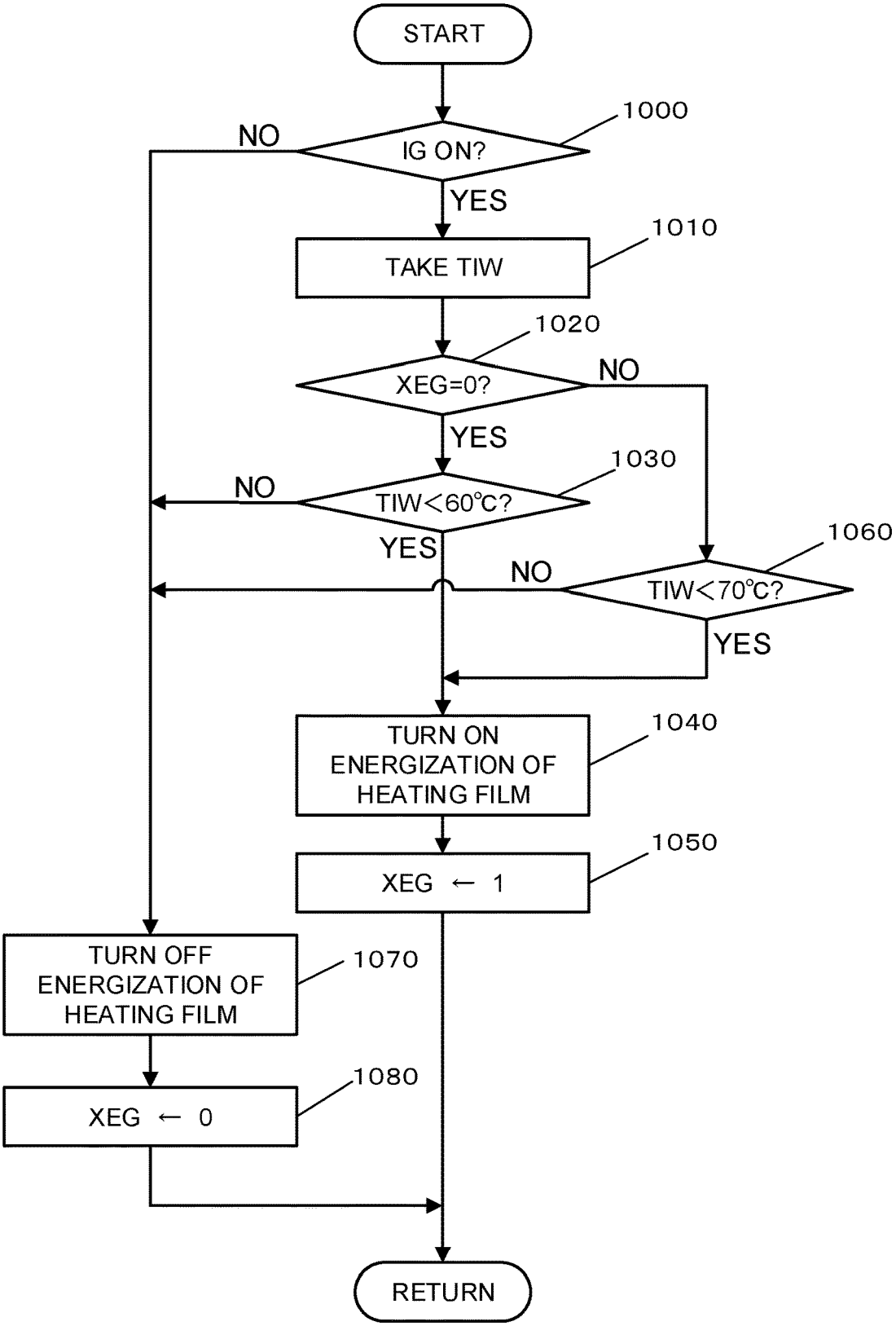
FIG. 30 is a flowchart showing the contents of seventh energization control in the eighth embodiment.

FIG. 30 is a flowchart showing the contents of the seventh energization control in the present embodiment. When the processing is shifted to this routine, in step 1000, the ECU 80 determines whether or not IG is ON, that is, the engine 1 has started a startup operation, based on a detection signal from the IG switch 78. When this determination result is YES, the ECU 80 advances the processing to step 1010. When this determination result is NO, the ECU 80 shifts the processing to step 1070.

In step 1010, the ECU 80 takes the inner wall temperature TIW based on a detection signal of the temperature sensor 81.

In step 1020, the ECU 80 determines whether or not an energization flag XEG, which will be mentioned later, is 0. When this determination result is YES, the ECU 80 advances the processing to step 1030. When this determination result is NO, the ECU 80 shifts the processing to step 1060.

In step 1030, the ECU 80 determines whether or not the inner wall temperature TIW is lower than 60° C. This value 60° C. is one example and is assumed as the dew-point temperature. When this determination result is YES, the ECU 80 advances the processing to step 1040. When this determination result is NO, the ECU 80 shifts the processing to step 1070.

Since the inner wall temperature TIW is lower than the dew-point temperature, in step 1040, the ECU 80 turns on energization of each heating film 29 and 30 to heat the inner walls of the EGR gas distributor 15.

In step 1050, the ECU 80 sets the energization flag XEG to 1 and then returns the processing to step 1000.

In step 1060 following step 1020, the ECU 80 determines whether or not the inner wall temperature TIW is lower than 70° C. which is slightly higher than 60° C. This value 70° C. is one example and corresponds to the temperature at which it is presumable that condensed water is no longer generated. When this determination result is YES, the ECU 80 advances the processing to step 1040. When this determination result is NO, the ECU 80 shifts the processing to step 1070.

In step 1070 following step 1000, step 1030, or step 1060, the ECU 80 turns off energization of each heating film 29 and 30 to avoid heating the inner walls of the EGR gas distributor 15.

In step 1080, the ECU 80 sets the energization flag XEG to 0 and then returns the processing to step 1000.

According to the above-described seventh energization control, the ECU 80 is configured to control energization of each heating film 29 and 30 from before start of EGR based on the detected inner wall temperature TIW (the warm-up state).

(Operations and Effects of the EGR System)

According to the above-described EGR system configured as above in the present embodiment, differently from each of the foregoing embodiments, the energization of each heating film 29 and 30 is controlled based on the actually detected inner wall temperature TIW (the warm-up state), so that the temperature of the inner walls of the EGR gas distributor 15 can be further accurately controlled.

Ninth Embodiment

A ninth embodiment will be described below in detail with reference to the accompanying drawings.

(Intake Passage for Flowing EGR Gas)

This ninth embodiment differs from each of the foregoing embodiments in the positions of the heating films provided in an engine system. The foregoing embodiments each describe the heating films 29 and 30 provided on the inner walls of the casings 26 and 27 in the EGR gas distributor 15 (the EGR passage) and the electrical configuration for energization of the heating films 29 and 30, and the configuration for the energization control thereof. In the present embodiment, in contrast, the heating films 29 and 30 and the electrical configuration for energization in the foregoing embodiments are provided in the intake passage 2 (including the intake manifold 5) through which EGR gas is allowed to flow, not in the EGR gas distributor 15.

Figure 31:
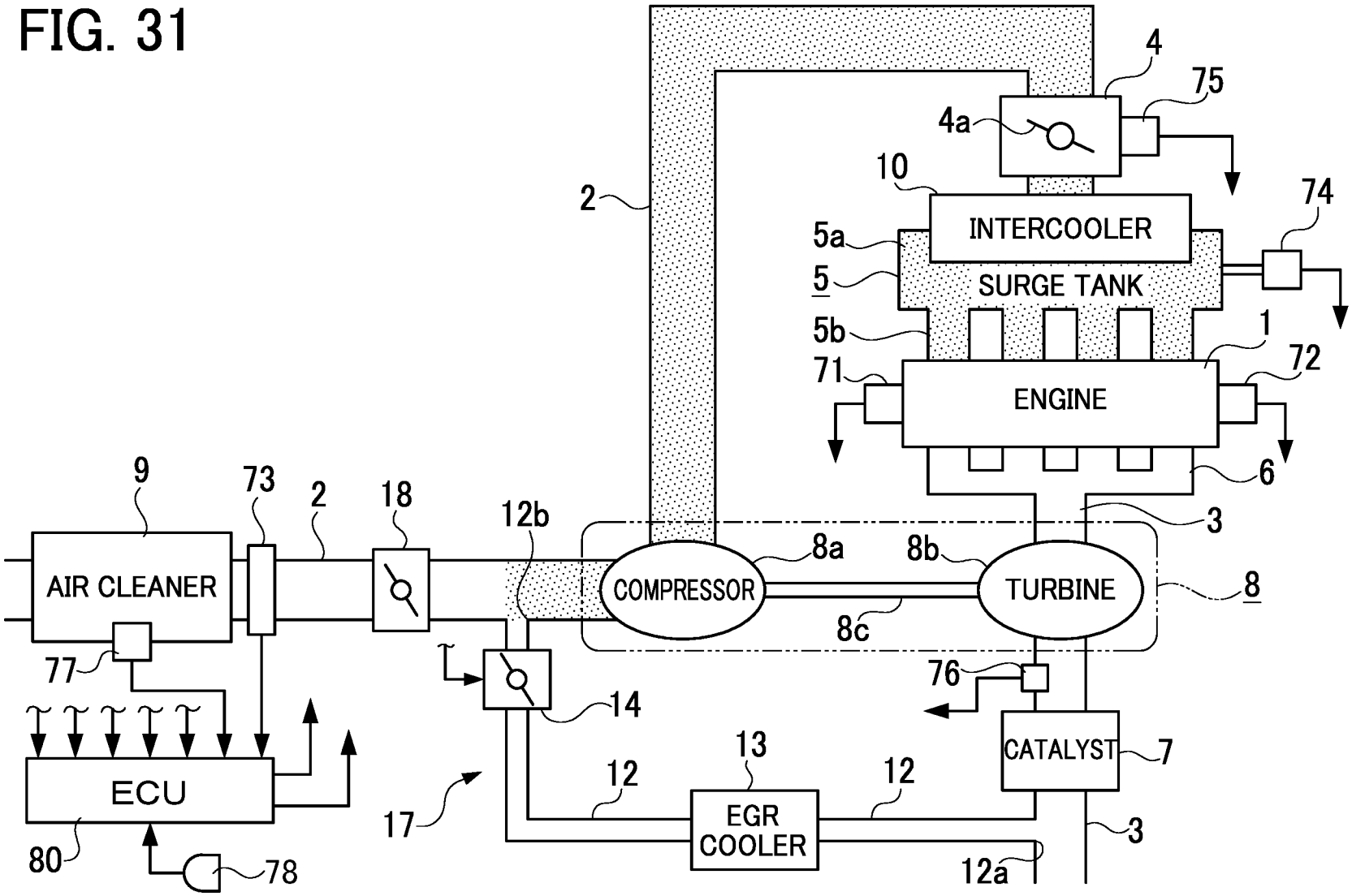
FIG. 31 is a schematic configuration view of an engine system in a ninth embodiment.

Specifically, FIG. 31 is a schematic configuration view of the engine system. This engine system is configured such that a supercharger 8 is placed in the intake passage 2 and the exhaust passage 3 of the engine 1, and a low-pressure loop EGR device 17 is placed between the intake passage 2 and the exhaust passage 3, as shown in FIG. 31. The supercharger 8 includes a compressor 8*a* provided in the intake passage 2, a turbine 8*b* provided in the exhaust passage 3, and a rotary shaft 8*c* with which the compressor 8*a* and the turbine 8*b* are rotated together. The compressor 8*a* is placed in the intake passage 2 upstream of the throttle device 4. In the intake passage 2 upstream of the compressor 8*a*, there are provided an intake throttle valve 18 and an air cleaner 9. The turbine 8*b* is placed in the exhaust passage 3 between the exhaust manifold 6 and the catalyst 7. The surge tank 5*a* is provided with an intercooler 10. An EGR passage 12 constituting the EGR device 17 includes an inlet 12*a* connected to the exhaust pas sage 3 downstream of the catalyst 7 and an outlet 12*b* connected to the intake passage 2 between the compressor 8*a* and the intake throttle valve 18.

In FIG. 31, such parts of the intake passage 2 as provided with the heating films 29 and 30 and the electrical configuration for energization thereof in each foregoing embodiment are hatched with dots. In the present embodiment, specifically, the heating films 29 and 30 and the electrical configuration for energization thereof in each foregoing embodiment are provided in a part of the intake passage 2 between the outlet 12*b* of the EGR passage 12 and the compressor 8*a* and in a part of the intake passage 2 between the compressor 8*a* and the engine 1, and further in the intake manifold 5. In the present embodiment, the ECU 80 may be configured to execute at least one of the first to seventh energization controls and the EGR start water temperature setting control which are described in the foregoing embodiments.

(Operations and Effects of the EGR System)

The EGR system configured as above in the present embodiment can achieve the operations and effects equivalent to those in the operations and effects in the foregoing embodiments in relation to energization of the parts of the intake passage 2 and the intake manifold 5, in which each heating film 29 and 30 and the electrical configuration for energization thereof are provided.

Tenth Embodiment

A tenth embodiment will be described below in detail with reference to the accompanying drawings.

(Eighth Energization Control of Heating Films)

This tenth embodiment differs from the eighth embodiment in the contents of the eighth energization control of each heating film 29 and 30.

The temperature-rising properties of each heating film 29 and 30 will be studied below. In the present embodiment, each heating film 29 and 30 is formed on the inner surface of resin casings 26 and 27 each having low thermal conductivity. It is therefore confirmed that the resultant heat insulating effect could provide temperature-rising properties much better than cooling water. It is further confirmed that each heating film 29 and 30 has an electrical resistance that decreases as a temperature is lower and thus provides good temperature-rising properties. Herein, in light of combustion in the engine 1, as the outside temperature (the intake temperature THA and the cooling water temperature THW) is lower, the combustion temperature is lower and the combustion resistant force decreases, so that there is no other choice to increase the cooling water temperature THW for starting EGR to a higher temperature side. Thus, it is possible to ensure more time to increase the temperature of each heating film 29 and 30 as the at-startup cooling water temperature STHW is lower. In the present embodiment, therefore, the eighth energization control is performed to control the timing of start of energization of each heating film 29 and 30 according to a difference in warm-up state at startup of the engine 1 (the intake temperature THA and the cooling water temperature THW) as described above.

Figure 32:
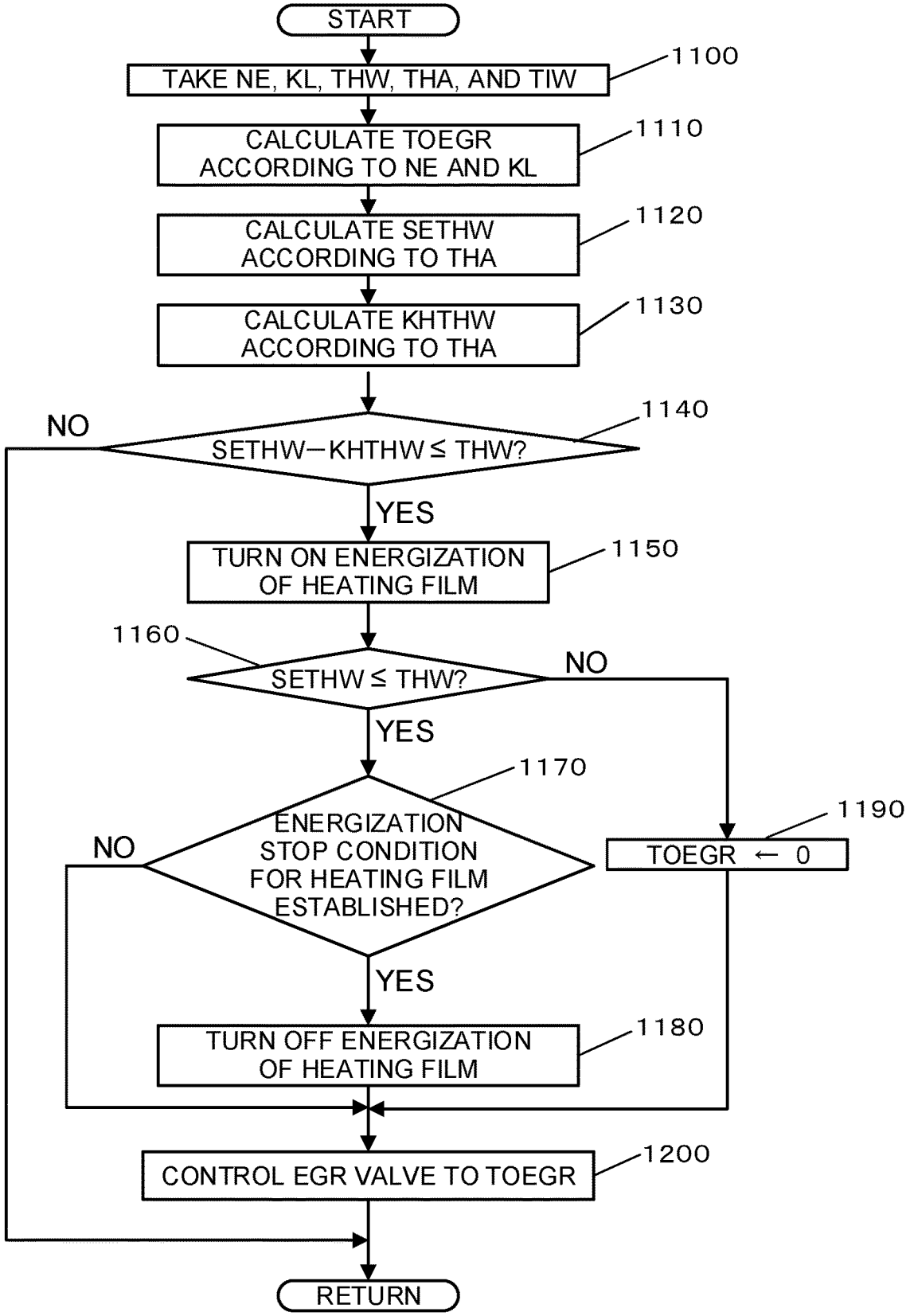
FIG. 32 is a flowchart showing the contents of eighth energization control in a tenth embodiment.

FIG. 32 is a flowchart showing the contents of the eighth energization control. When the processing shifts to this routine, the ECU 80 takes, in step 1100, an engine rotation speed NE, an engine load KL, a cooling water temperature THW, an intake temperature THA, and an inner wall temperature TIW respectively based on detected values of various sensors and others 71 to 77 and 81.

In step 1110, the ECU 80 then calculates a target EGR opening degree TOEGR according to the engine rotation speed NE and the engine load KL. The target EGR opening degree TOEGR is a command value to control the opening degree of the EGR valve 14. The ECU 80 can obtain this target EGR opening degree TOEGR according to the engine rotation speed NE and the engine load KL by referring to for example a predetermined target EGR opening degree map (not shown).

Figure 33:
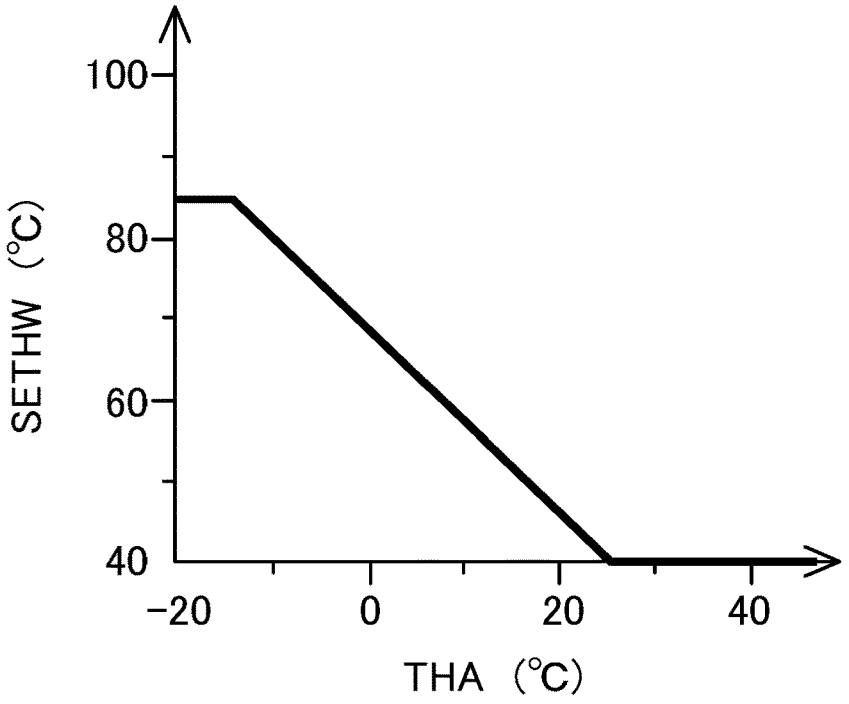
FIG. 33 is an EGR start water temperature map which is referred to in order to obtain an EGR start water temperature according to an intake temperature in the tenth embodiment.

In step 1120, the ECU 80 calculates an EGR start water temperature SETHW according to the intake temperature THA. The ECU 80 can obtain this EGR start water temperature SETHW according to the intake temperature THA by referring to for example an EGR start water temperature map as shown in FIG. 33. In this map, the EGR start water temperature SETHW is set lower in a range from 85 to 40 (° C.) as the intake temperature THA is higher in a range of −15 to 25 (° C.). Further, in this map, the EGR start water temperature SETHW is constant at 85° C. when the intake temperature THA is equal to or lower than −15° C., while the EGR start water temperature SETHW is constant at 40° C. when the intake temperature THA is equal to or higher than 25° C.

Figure 34:
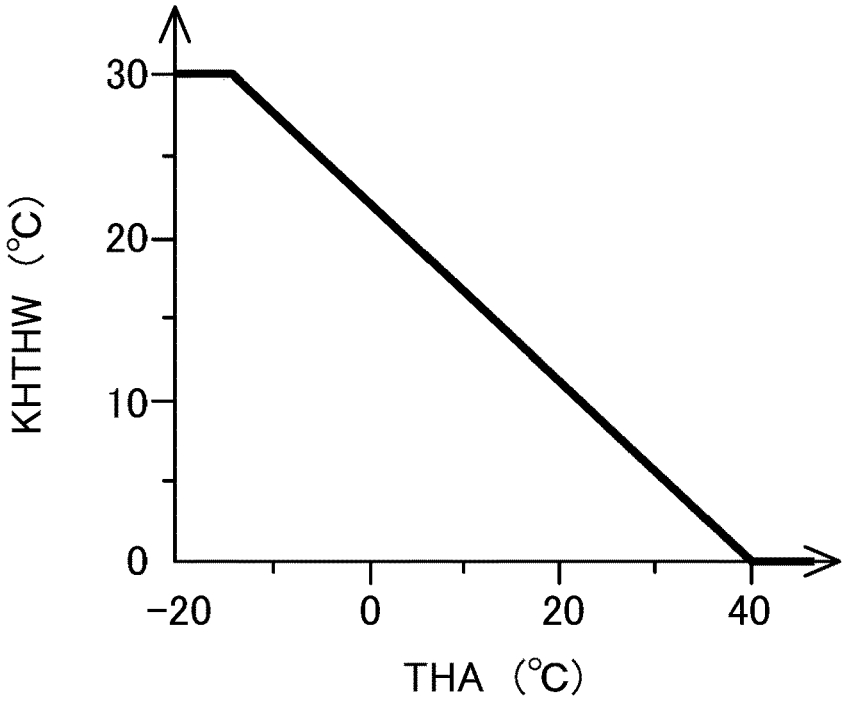
FIG. 34 is a corrected water temperature map which is referred to in order to obtain a corrected water temperature according to the intake temperature in the tenth embodiment.

In step 1130, the ECU 80 subsequently calculates a corrected water temperature KHTHW according to the intake temperature THA in order to correct the cooling water temperature THW for starting of energization of each heating film 29 and 30. The ECU 80 can obtain this corrected water temperature KHTHW according to the intake temperature THA by referring to for example a corrected water temperature map as shown in FIG. 34. In this map, the corrected water temperature KHTHW is set lower in a range from 30 to 0 (° C.) as the intake temperature THA is higher in a range of −15 to 40 (° C.). Further, in this map, the corrected water temperature KHTHW is constant at 30° C. when the intake temperature THA is equal to or lower than −15° C., while the corrected water temperature KHTHW is constant at 0° C. when the intake temperature THA is equal to or higher than 40° C.

In step 1140, the ECU 80 determines whether or not the cooling water temperature THW is equal to or higher than a temperature obtained by subtracting the corrected water temperature KHTHW from the EGR start water temperature SETHW. Herein, this subtraction of the corrected water temperature KHTHW from the EGR start water temperature SETHW is intended to reflect the effect that the temperature-rising properties of each heating film 29 and 30 are better as the intake temperature THA is lower into the timing of start of energization of each heating film 29 and 30. When this determination result is YES, the ECU 80 judges that the intake temperature THA has reached the cooling water temperature THW at which the energization of each heating film 29 and 30 can be started, and shifts the processing to step 1150. Further, when this determination result is NO, the ECU 80 judges that the intake temperature THA has not reached the cooling water temperature THW at which the energization of each heating film 29 and 30 can be started, and returns the processing to step 1100.

In step 1150, the ECU 80 turns on energization of each heating film 29 and 30, that is, starts energization of each heating film 29 and 30.

In step 1160, the ECU 80 then determines whether or not the cooling water temperature THW is equal to or higher than the EGR start water temperature SETHW. When this determination result is YES, the ECU 80 advances the processing to step 1170. When this determination result is NO, the ECU 80 shifts the processing to step 1190.

In step 1170, the ECU 80 determines whether or not an energization stop condition to stop energization of each heating film 29 and 30 is established. Herein, as the energization stop condition, it is assumable to predict and determine a temperature based on an energization time (see FIG. 11), a water temperature condition (see FIG. 14), and a current value or a resistance value of each heating film 29 and 30. When this determination result is YES, the ECU 80 advances the processing to step 1180. When this determination result is NO, the ECU 80 shifts the processing to step 1200.

In step 1180, the energization stop condition has been established and thus the ECU 80 turns off energization of each heating film 29 and 30.

In step 1190, on the other hand, the ECU 80 sets the target EGR opening degree TOEGR to 0 in order to cut off EGR and shifts the processing to step 1200.

In step 1200 following step 1170, 1180, or 1190, the ECU 80 controls the EGR valve 14 to the target EGR opening degree TOEGR. Specifically, when the target EGR opening degree TOEGR is a predetermined opening degree other than 0, the ECU 80 controls the EGR valve 14 to that opening degree. On the other hand, when the target EGR opening degree TOEGR is 0, the ECU 80 controls the EGR valve 14 to fully close. Thereafter, the ECU 80 returns the processing to step 1100.

According to the above-described eighth energization control, the ECU 80 is configured to control energization of each heating film 29 and 30 from before start of EGR based on the warm-up states of the intake passage 2 and the EGR passage 12 (including the EGR gas distributor 15). Herein, for energization of each heating film 29 and 30, the ECU 80 is configured to start energization of each heating film 29 and 30 according to the above-mentioned warm-up states at startup of the engine 1. Specifically, the ECU 80 is configured to: (i) calculate a temperature (i.e., an energization-start warm-up state to start energization) by subtracting the corrected water temperature KHTHW from the EGR start water temperature SETHW according to the intake temperature THA (the warm-up state) at startup of the engine 1; and (ii) turn on, i.e., start, energization of each heating film 29 and 30 when the cooling water temperature THW (the warm-up state) becomes the temperature obtained by subtracting the corrected water temperature KHTHW from the EGR start water temperature SETHW, after startup of the engine 1. The ECU 80 is further configured to obtain each of the EGR start water temperature SETHW and the corrected water temperature KHTHW according to the detected intake temperature THA (the warm-up state).

(Operations and Effects of the EGR System)

The above-described EGR system configured as above in the present embodiment can achieve the following operations and effects. Specifically, the temperature-rising properties of each heating film 29 and 30 are likely to be better as the temperature of each heating film 29 and 30 at startup of the engine 1 is lower. By using the intake temperature THA as a substitute for the temperature of each film at startup of the engine 1, the ECU 80 calculates a temperature (i.e., the energization-start warm-up state) by subtracting the corrected water temperature KHTHW from the EGR start water temperature SETHW according to the relevant intake temperature THA, and starts energization of each heating film 29 and 30 when the cooling water temperature THW (the warm-up state) after startup of the engine 1 becomes the temperature obtained by subtracting the corrected water temperature KHTHW from the EGR start water temperature SETHW. Accordingly, energization of each heating film 29 and 30 is started based on the temperature-rising properties according to the warm-up state. This can cause each heating film 29 and 30 to generate heat for only the time needed to heat the inner walls of the EGR gas distributor 15 and can avoid unnecessary heat generation. This can save power of the system and hence ensure a long durable time of each heating film 29 and 30.

Eleventh Embodiment

An eleventh embodiment will be described below in detail with reference to the accompanying drawings.

This eleventh embodiment differs from the tenth embodiment in the electrical configuration of an engine system and the contents of the ninth energization control of each heating film 29 and 30. Specifically, the electrical configuration in the present embodiment is configured, as in the fourth embodiment, such that the ECU 80 includes a pre ECU **80*a* that operates before startup of the engine 1 and the ECU 80 is also connected to a door sensor 79 (see FIG. 20**).

(Ninth Energization Control of Heating Films)

Figure 35:
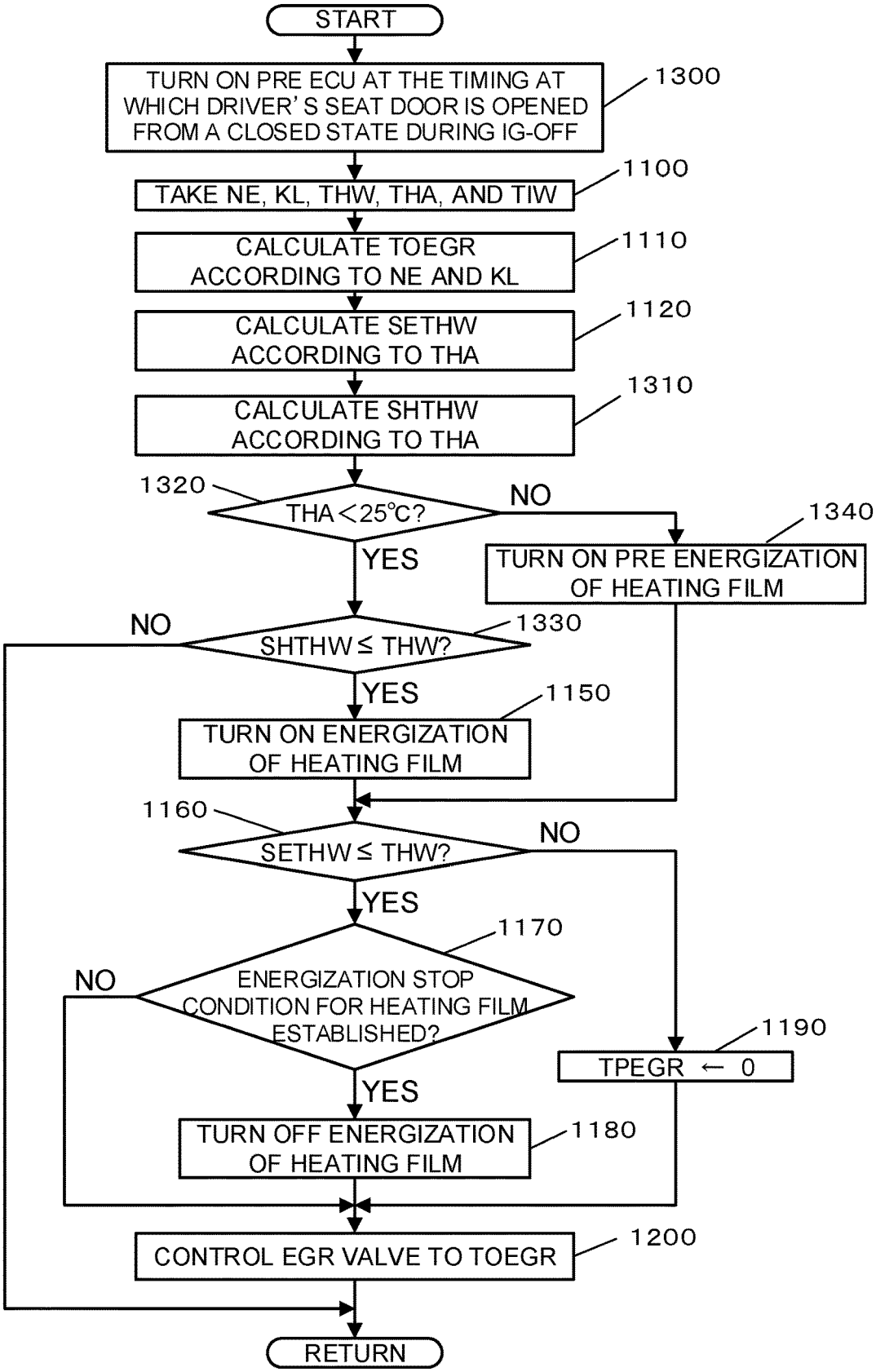
FIG. 35 is a flowchart showing the contents of the ninth energization control in an eleventh embodiment.

FIG. 35 is a flowchart showing the contents of the ninth energization control in the present embodiment. The flowchart in FIG. 35 differs from the flowchart in FIG. 32 in that step 1300 is provided before step 1100 and steps 1310 to 1340 are provided instead of steps 1130 and 1140.

When the processing shifts to this routine, in step 1300, the ECU 80 turns on the pre ECU 80*a* at the timing when a driver's seat door is opened from a closed state while IG is OFF. The ECU 80 is configured to determine whether or not the driver's seat door is opened from the closed state based on a detection result of the door sensor 79.

Figure 36:
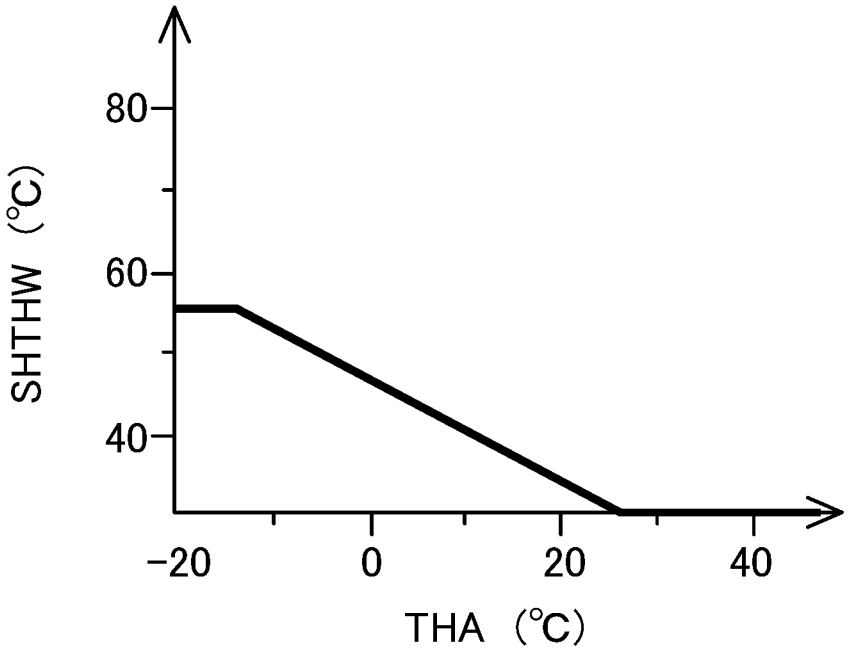
FIG. 36 is an energization-start water temperature map which is referred to in order to obtain an energization-start water temperature according to an intake temperature in the eleventh embodiment.

The ECU 80 then performs the processings in steps 1100 to 1120 and further calculates an energization-start water temperature SHTHW (unit: ° C.) according to the intake temperature THA in step 1310. The energization-start water temperature SHTHW means the cooling water temperature THW for starting energization of each heating film 29 and 30 after startup of the engine 1. The ECU 80 can obtain the energization-start water temperature SHTHW according to the intake temperature THA by referring to for example an energization-start water temperature map as shown in FIG. 36. In this map, the energization-start water temperature SHTHW is set lower in a range from 55 to 30 (° C.) as the intake temperature THA is higher in a range from −15 to 25 (° C.). Further, in this map, the energization-start water temperature SHTHW is constant at 55° C. when the intake temperature THA is equal to or lower than −15° C., while the energization-start water temperature SHTHW is constant at 30° C. when the intake temperature THA is equal to or higher than 25° C.

In step 1320, the ECU 80 determines whether or not the intake temperature THA is lower than 25° C. This value 25° C. is one example. When this determination result is YES, the ECU 80 advances the processing to step 1330. When this determination result is NO, the ECU 80 shifts the processing to step 1340.

In step 1330, the ECU 80 determines whether or not the cooling water temperature THW is equal to or higher than the energization-start water temperature SHTHW. When this determination result is YES, the ECU 80 advances the processing to step 1150 and executes the above-described processings in step 1150 and subsequent steps. When this determination result is NO, the ECU 80 returns the processing to step 1300.

In step 1340 following step 1320, on the other hand, the ECU 80 turns on pre-energization of each heating film 29 and 30. In other words, the ECU 80 starts pre-energization of each heating film 29 and 30 before startup of the engine 1. Then, the ECU 80 advances the processing to step 1160 and executes the processings in step 1160 and subsequent steps.

According to the above-described ninth energization control, the ECU 80 is configured to control energization of each heating film 29 and 30 from before start of EGR based on the warm-up states of the intake passage 2 and the EGR passage 12 (including the EGR gas distributor 15). Herein, for energization of each heating film 29 and 30, the ECU 80 is configured to start energization of each heating film 29 and 30 according to the warm-up states at startup of the engine 1. Specifically, the ECU 80 is configured to: (i) calculate the energization-start water temperature SHTHW (the energization-start warm-up state to start energization) according to the intake temperature THA (the warm-up state) at startup of the engine 1; and (ii) turn on, i.e., start, energization of each heating film 29 and 30 when the cooling water temperature THW (the warm-up state) becomes the energization-start water temperature SHTHW after startup of the engine 1. Further, the ECU 80 is configured to obtain each of the EGR start water temperature SETHW and the energization-start water temperature SHTHW according to the detected intake temperature THA (the warm-up state).

When the intake temperature THA is high, herein, a difference between the intake temperature THA and the EGR start water temperature SETHW is small. Even if energization of each heating film 29 and 30 is started, the energization time is short. According to the above-described ninth energization control, therefore, when the ECU 80 (i.e., the pre ECU 80*a*) judges that the detected intake temperature THA (the warm-up state) has reached a predetermined 25° C. (the warm-up state) before startup of the engine 1, the ECU 80 (i.e., the pre ECU 80*a*) is configured to turn on, i.e., start, pre-energization of each heating film 29 and 30 from before startup of the engine 1.

(Operations and Effects of the EGR System)

The above-described EGR system configured as above in the present embodiment can achieve the following operations and effects. Specifically, the ECU 80 calculates the energization-start water temperature SHTHW (the energization-start warm-up state) according to the intake temperature THA at startup of the engine 1, and turns on, i.e., starts, energization of each heating film 29 and 30 when the cooling water temperature THW (the warm-up state) becomes the energization-start water temperature SHTHW after startup of the engine 1. Thus, energization of each heating film 29 and 30 is started based on the temperature-rising properties according to the warm-up state. This can cause each heating film 29 and 30 to generate heat for only the time needed to heat the inner walls of the EGR gas distributor 15 and can avoid unnecessary heat generation. This configuration can save power of the system and ensure a long durable time of each heating film 29 and 30.

According to the present embodiment configured as above, each heating film 29 and 30 is subjected to pre-energization before startup of the engine 1, so that each heating film 29 and 30 generates heat from before startup of the engine 1 and thus the heating temperature thereof is increased moderately. Accordingly, the temperature of the inner walls of the EGR gas distributor 15 can be increased to a moderate temperature by the time of startup of the engine 1. This can reliably suppress the generation of condensed water in the EGR gas distributor 15 when EGR is started.

The foregoing embodiments are mere examples and give no limitation to the present disclosure. The present disclosure may be embodied in other specific forms without departing from the essential characteristics thereof.

Figure 37:
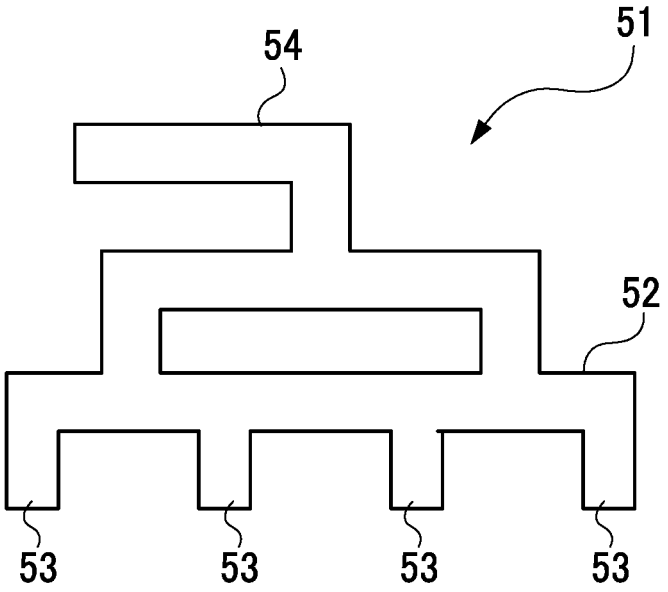
FIG. 37 is a plan view of an EGR gas distributor in another embodiment.
Figure 38:
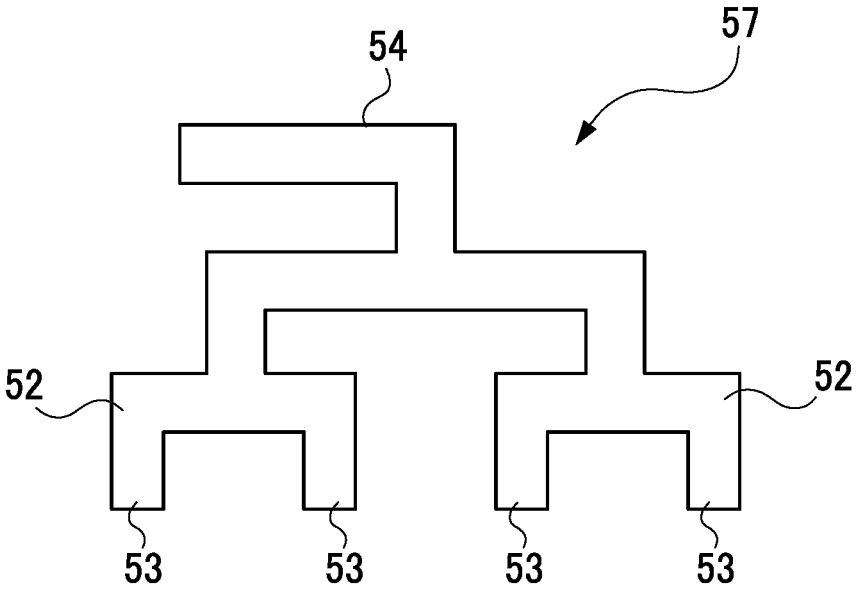
FIG. 38 is a plan view of an EGR gas distributor in still another embodiment.

(1) In each of the foregoing embodiments, as shown in FIG. 4, the EGR gas distributor 15 is constituted of the gas inflow passage 21 (including the passage part 21*a* and two branch passage parts 21*b* and 21*c*), the single gas chamber 22 (having the inner diameter larger than the inner diameter of the gas inflow passage 21), and the four gas distribution passages 23 (having the inner diameter smaller than each inner diameter of the gas inflow passage 21 and the gas chamber 22). As an alternative, as shown in a plan view of FIG. 37, an EGR gas distributor 51 may be configured such that a gas chamber 52 and each gas distribution passage 53 are designed with the same inner diameter as that of a gas inflow passage 54. As another alternative, the gas chamber 52 in FIG. 37 may be divided at its middle portion into two, so that an EGR gas distributor 57 entirely has a tournament shape as shown in a plan view of FIG. 38.

(2) In each of the foregoing embodiments, both the upper heating film 29 and the lower heating film 30 provided in the EGR gas distributor 15 or the intake passage 2 for flowing EGR gas and the intake manifold 5 are simultaneously energized. As an alternative, the heating films 29 and 30 may be energized individually.

(3) In the foregoing third embodiment, for energization of each heating film 29 and 30, a current value for energizing each heating film 29 and 30 is controlled based on the warm-up states at startup of the engine 1. As an alternative, for energization of a heating film, a voltage value of energization of a heating film may be controlled based on a warm-up state at startup of an engine.

(4) In the foregoing seventh embodiment, for energization of each heating film 29 and 30, it is arranged such that a current value for energizing each heating film 29 and 30 is increased according to a difference between the warm-up state of the intake passage 2 and the EGR passage 12 (including the EGR gas distributor 15) at startup of the engine 1 and the above-mentioned warm-up state to start EGR. As an alternative, for energization of the heating films, it may be arranged such that a voltage value for energizing the heating films is increased according to a difference between the warm-up states of the intake passage and the EGR passage at engine startup and the above-mentioned warm-up state to start EGR.

INDUSTRIAL APPLICABILITY

The present disclosure is available for an intake passage for flowing EGR gas and an EGR passage in a gasoline engine and a diesel engine.

REFERENCE SIGNS LIST

1 Engine
2 Intake passage
3 Exhaust passage
5 Intake manifold (Intake passage)
12 EGR passage
15 EGR gas distributor (EGR passage)
29 Upper heating film
30 Lower heating film
31 Upper positive electrode
32 Upper negative electrode
33 Lower positive electrode
34 Lower negative electrode
51 EGR gas distributor (EGR passage)
57 EGR gas distributor (EGR passage)
71 Water temperature sensor (Warm state detecting unit)
77 Intake-air temperature sensor (Warm state detecting unit)
80 ECU (Energization control unit, EGR control unit)
81 Temperature sensor (Warm state detecting unit)
THW Cooling water temperature (Warm state)
STHW At-startup cooling water temperature (Warm state)
THA Intake temperature (Warm state)
STHA At-startup intake temperature (Warm state)
TIW Inner wall temperature (Warm state)

What is claimed is:

1. An EGR system configured to allow a part of exhaust gas discharged from an engine to an exhaust passage to flow as an EGR gas to an intake passage through an EGR passage to return to the engine, the EGR system comprising:

a heating film provided on an inner wall of at least one of the intake passage through which the EGR gas is allowed to flow and the EGR passage;

at least one pair of a positive electrode and a negative electrode to energize the heating film;

a warm-up state detecting unit configured to detect a warm-up state of the intake passage and the EGR passage; and an energization control unit configured to control energization of the heating film based on the detected warm-up state from before start of EGR.

2. The EGR system according to claim 1, wherein for energization of the heating film, the energization control unit is configured to control an energization time based on the warm-up state at startup of the engine.

3. The EGR system according to claim 1, wherein for energization of the heating film, the energization control unit is configured to:

calculate an energization-cutoff warm-up state to cut off the energization based on the warm-up state at startup of the engine; and energize the heating film and then cut off the energization based on the energization-cutoff warm-up state.

4. The EGR system according to claim 1, wherein for energization of the heating film, the energization control unit is configured to control a current value or a voltage value for the energization based on the warm-up state at startup of the engine.

5. The EGR system according to claim 4, wherein for energization of the heating film, the energization control unit is configured to increase the current value or the voltage value for the energization according to a difference between the warm-up state at startup of the engine and the warm-up state to start the EGR.

6. The EGR system according to claim 1, wherein the energization control unit is configured to start the energization of the heating film before startup of the engine based on the warm-up state before startup of the engine.

7. The EGR system according to claim 1, wherein when EGR cutoff is continued for a predetermined time, the energization control unit is configured to perform re-energization of the heating film based on the warm-up state after startup of the engine.

8. The EGR system according to claim 1, wherein the energization control unit is configured to calculate an energization-start warm-up state to start the energization according to the warm-up state at startup of the engine, and start the energization of the heating film when the warm-up state becomes the energization-start warm-up state after startup of the engine.

9. The EGR system according to claim 1, further including an EGR control unit configured to control the EGR, wherein when a difference is small between the warm-up state at startup of the engine and the warm-up state to start the EGR, the EGR control unit is configured to change the warm-up state to start the EGR to a warm-up state on a high temperature side.

10. The EGR system according to claim 1, wherein the warm-up state is indicated by a parameter including at least one of a temperature of intake air to be sucked in the engine, a temperature of cooling water of the engine, a temperature of the inner wall of the intake passage, and a temperature of the inner wall of the EGR passage.

* * * * *